US011608242B2

(12) United States Patent
Miyazawa et al.

(10) Patent No.: US 11,608,242 B2
(45) Date of Patent: Mar. 21, 2023

(54) POST-PROCESSING DEVICE

(71) Applicant: Seiko Epson Corporation, Tokyo (JP)

(72) Inventors: Masaki Miyazawa, Matsumoto (JP); Shun Hara, Matsumoto (JP); Kazuhisa Kawakami, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/387,658

(22) Filed: Jul. 28, 2021

(65) Prior Publication Data

US 2022/0032662 A1 Feb. 3, 2022

(30) Foreign Application Priority Data

Jul. 30, 2020 (JP) ..... JP2020-129374

(51) Int. Cl.
*B65H 29/22* (2006.01)
*B65H 37/04* (2006.01)
*B65H 31/36* (2006.01)

(52) U.S. Cl.
CPC ..... *B65H 37/04* (2013.01); *B65H 29/22* (2013.01); *B65H 31/36* (2013.01)

(58) Field of Classification Search
CPC ..... B65H 29/20; B65H 29/22; B65H 29/38; B65H 29/40; B65H 31/34; B65H 2301/363; B65H 2404/65; B65H 2408/114; B65H 2408/1142
USPC ..... 270/58.12, 58.17
See application file for complete search history.

(56) References Cited

U.S. PATENT DOCUMENTS

| | | | | |
|---|---|---|---|---|
| 6,220,592 | B1 * | 4/2001 | Watanabe | B65H 31/36 271/220 |
| 7,043,192 | B2 * | 5/2006 | Terao | G03G 15/6541 270/58.08 |
| 7,530,565 | B2 * | 5/2009 | Terao | B65H 31/3018 271/220 |
| 7,874,553 | B2 * | 1/2011 | Kushida | B65H 31/02 271/220 |
| 9,718,635 | B2 * | 8/2017 | Sato | B65H 29/36 |
| 9,758,335 | B2 * | 9/2017 | Taki | B65H 29/26 |
| 10,071,875 | B2 * | 9/2018 | Taki | B65H 37/04 |
| 10,882,710 | B2 * | 1/2021 | Taki | B65H 31/02 |
| 2008/0290576 | A1 * | 11/2008 | Kato | G03G 15/6538 270/58.11 |

FOREIGN PATENT DOCUMENTS

| | | | |
|---|---|---|---|
| JP | 08012173 A | * | 1/1996 |
| JP | 2009-040524 | | 2/2009 |

* cited by examiner

*Primary Examiner* — Leslie A Nicholson, III
(74) *Attorney, Agent, or Firm* — Workman Nydegger

(57) ABSTRACT

A post-processing device includes a processing tray on which a medium recorded by a recording portion is loaded, and a first paddle which is an example of a transportation member provided above the processing tray and rotating to transport the medium toward the upstream in a transport direction. In addition, the post-processing device includes a roller which is an example of a rotating body provided above the rotation shaft of the first paddle, and a paddle unit frame which is an example of an upper member provided above the roller. The roller and the paddle unit frame are positioned within a rotation locus of the first paddle.

15 Claims, 8 Drawing Sheets

POST-PROCESSING DEVICE

The present application is based on, and claims priority from JP Application Serial Number 2020-129374, filed Jul. 30, 2020, the disclosure of which is hereby incorporated by reference herein in its entirety.

BACKGROUND

1. Technical Field

The present disclosure relates to a post-processing device that performs post-processing on a medium such as a recorded paper sheet.

2. Related Art

For example, JP-A-2009-40524 discloses a post-processing device that receives media such as paper sheets discharged from an image forming apparatus, accommodates the media on a registration tray, and staples the media by using a stapler. The post-processing device includes a registration paddle (an example of a transportation member) and a registration belt that feed the media fed onto the registration tray one by one. A plurality of media are registered in a feeding direction by being fed until end portions of the media on the registration tray are brought into contact with a reference stopper.

SUMMARY

However, the post-processing device described in JP-A-2009-40524 uses a rotary registration paddle as the transportation member for transporting the media until the end portions of the media are brought into contact with the reference stopper, and it is thus necessary to secure a space for a rotation locus of the transportation member such as the registration paddle. In this case, there is a problem that the size of the post-processing device in a height direction increases. Meanwhile, when trying to reduce the size of the post-processing device in the height direction, there is a problem that the transportation member such as the registration paddle slides relative to an upper member such as a frame covering an upper side thereof, such that the transportation member wears. Therefore, there is a demand for a post-processing device whose size in a height direction can be reduced while suppressing the wear of the transportation member caused by the sliding of the transportation member relative to the upper member such as the frame positioned above the transportation member.

According to an aspect of the present disclosure, a post-processing device includes: a processing tray on which a medium subjected to recording by a recording portion is loaded; a transportation member that is provided above the processing tray, and, by rotating around a rotation shaft, transports the medium toward upstream in a transport direction; a rotating body provided above the rotation shaft of the transportation member; and an upper member provided above the rotating body, in which the rotating body and the upper member are positioned within a rotation locus of the transportation member.

DESCRIPTION OF EXEMPLARY EMBODIMENTS

First Embodiment

Hereinafter, a recording system including a post-processing device according to a first embodiment will be described with reference to the drawings. The recording system performs, for example, a recording operation of performing recording on a medium such as a paper sheet and a post-processing operation of loading a plurality of recorded media and performing post-processing on a bundle of the loaded media.

Figure 1:
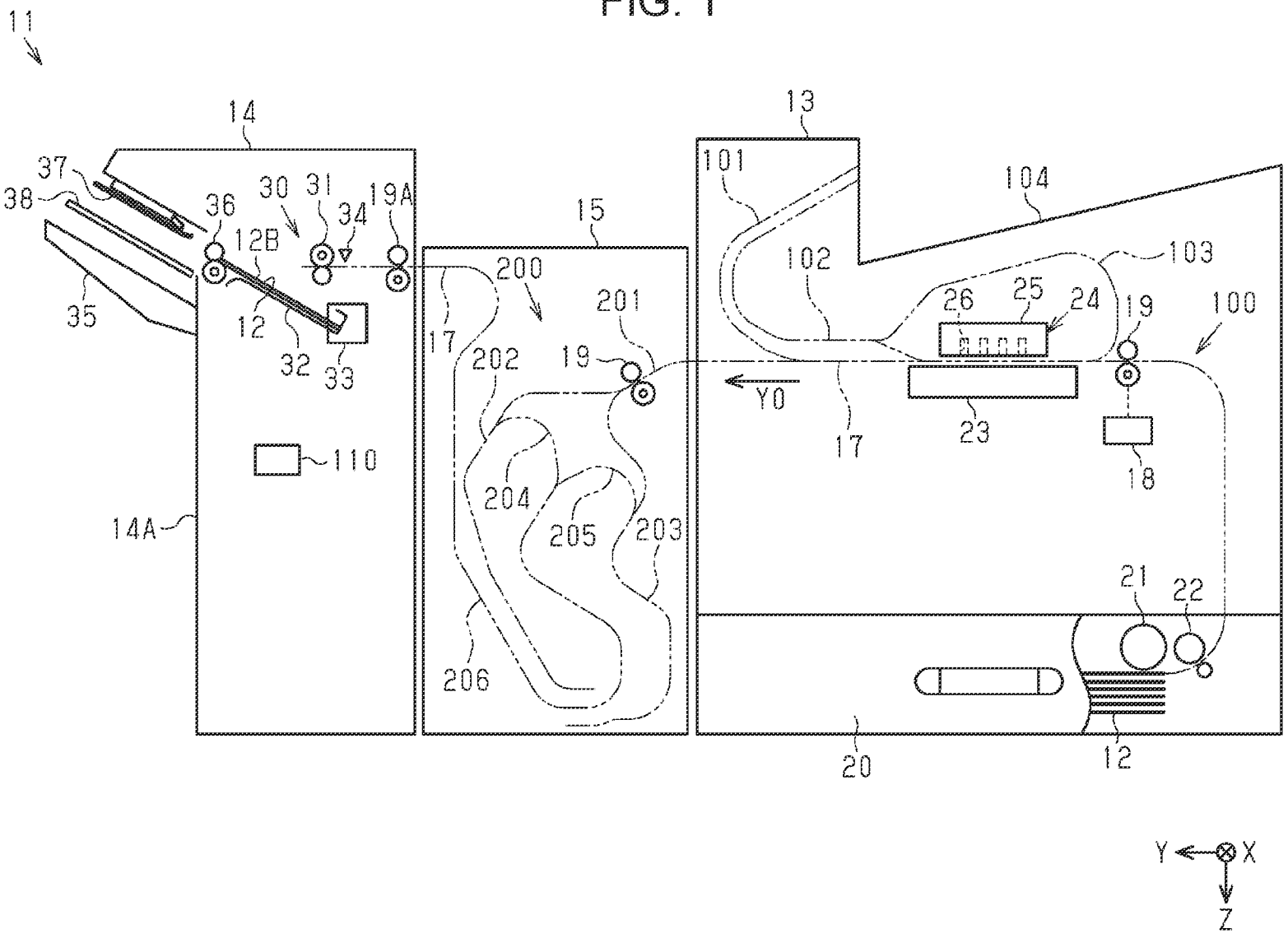
FIG. 1 is a schematic side cross-sectional view illustrating a recording system including a post-processing device according to a first embodiment.

In FIG. 1, on the assumption that a recording system 11 is placed on a horizontal plane, a direction of gravity is indicated by a Z axis, and two axes that intersect each other along a plane intersecting the Z axis are indicated by an X axis and a Y axis. The X axis, the Y axis, and the Z axis may be orthogonal to each other. In the following description, a direction parallel to the X axis is referred to as a width direction X, the direction of gravity parallel to the Z axis is referred to as a vertical direction Z, and a direction orthogonal to the width direction X along a transport path 17 is referred to as a transport direction Y0. The transport direction Y0 is a direction in which transport roller pairs 19, 19A, and 31 transport a medium 12, and changes according to the position of the medium 12 transported from a recording device 13 to a post-processing device 14.

As illustrated in FIG. 1, the recording system 11 includes the recording device 13 that performs recording on the medium 12, the post-processing device 14 that performs post-processing on the recorded medium 12, and an intermediate device 15 arranged between the recording device 13 and the post-processing device 14. The recording device 13 is, for example, an ink jet printer that ejects ink, which is an example of liquid, onto the medium 12 to record characters or images. The intermediate device 15 internally reverses the recorded medium 12 transported from the recording device 13 and then discharges the recorded medium 12 to the post-processing device 14. The post-processing device 14 performs post-processing on the recorded medium 12 transported from the intermediate device 15. The post-processing is, for example, stapling processing for binding a plurality of media 12. Note that the post-processing may include punching processing, saddle stitching processing, folding processing, or the like, in addition to the stapling processing. Here, the punching processing is processing for forming punch holes in one or more media 12.

The recording system 11 is provided with the transport path 17 that extends from the recording device 13 to the inside of the post-processing device 14 via the intermediate device 15 and is indicated by a line with alternating long and two short dashes in FIG. 1. The recording device 13 includes one or more transport roller pairs 19 that are driven by a transport motor 18 to transport the medium 12 along the transport path 17. In addition, the intermediate device 15 includes a reversing processing section 200 that reverses the recorded medium 12. The intermediate device 15 includes a transport motor (not illustrated) that drives one or more transfer roller pairs 19 included in the reversing processing section 200.

In addition, the recorded medium 12 reversed by the intermediate device 15 is transported to the post-processing device 14. The post-processing device 14 includes a transport mechanism 30 that transports the medium 12. The transport mechanism 30 includes the transport roller pairs 19A and 31 and a transport motor (not illustrated) that drives the transport roller pairs 19A and 31. The post-processing device 14 includes a processing tray 32 on which the medium 12 transported from the transport roller pair 31 is loaded, a post-processing mechanism 33 that performs post-processing on a medium bundle 12B loaded on the processing tray 32, a discharge mechanism 36 that discharges the post-processed medium bundle 12B from the processing tray 32, and a discharge stacker 35 on which the discharged medium bundle 12B is loaded. In addition, the post-processing device 14 may include a guide member 37 that guides the medium bundle 12B discharged by the discharge mechanism 36 from above and a medium support member 38 that temporarily supports the medium bundle 12B in a discharge process and then drops the medium bundle 12B onto the discharge stacker 35, the guide member 37 and the medium support member 38 being disposed above the discharge stacker 35. The post-processing device 14 may include an elevating mechanism that lowers the discharge stacker 35 as the amount of the medium bundle 12B loaded on the discharge stacker 35 increases. In addition, the post-processing device 14 includes a control portion 110. The control portion 110 controls the driving of the transport mechanism 30, the post-processing mechanism 33, the discharge mechanism 36, the guide member 37, the medium support member 38, and the like Note that the medium bundle 12B refers to a bundle of media 12 in which a plurality of media 12 are stacked in a state where their ends are aligned with each other. In addition, the post-processing is processing performed on one medium 12 or the medium bundle 12B, and is processing performed after pre-processing on the medium 12 or the medium bundle 12B on which the pre-processing such as recording or reversion is performed.

Next, a detailed configuration of the recording device 13 will be described. One or more cassettes 20 that accommodate the stacked media 12 are detachably provided in the recording device 13. The recording device 13 includes a pickup roller 21 that feeds the uppermost medium 12 among the media 12 accommodated in the cassette 20 and a separation roller 22 that separates the media 12 fed by the pickup roller 21 and feeds only one medium. The one fed medium 12 is transported along the transport path 17.

The recording device 13 includes a support portion 23 that is provided along the transport path 17 and supports the medium 12, and a recording portion 24 provided so as to face the support portion 23 while having the transport path 17 interposed therebetween. The recording portion 24 includes a liquid ejecting head 25 including a plurality of nozzles 26 that can eject liquid. The liquid ejecting head 25 ejects liquid such as ink from the nozzles 26 toward a portion of the medium 12 that is supported by the support portion 23 to thereby perform recording on the medium 12. The liquid ejecting head 25 is, for example, a line head. In line head, multiple nozzles 26 are arranged over the entire width of the medium 12 in the width direction X with a certain nozzle pitch, and thus can simultaneously eject the liquid over the entire width of the medium 12 in the width direction X. Note that the recording portion 24 may be a serial recording type. In a case of the serial recording type, the recording portion 24 includes a carriage (not illustrated) that can move in the width direction X, and the serial type liquid ejecting head 25 provided on the carriage, and the liquid ejecting head 25 ejects the liquid from the nozzles 26 toward the medium 12 while moving along with the carriage in the width direction X, such that recording corresponding to one scan (one row) is performed each time on the medium 12.

As illustrated in FIG. 1, the recording device 13 includes a transport section 100 that transports the medium 12. The transport section 100 includes, as a part of the transport path 17, a discharge path 101 through which the medium 12 is discharged, a switchback path 102 through which the medium 12 is switched back, and a reversing path 103 through which the medium 12 is reversed. The switchback path 102 and the reversing path 103 are used when double-sided recording is performed. In the double-sided printing, the medium 12 having a first surface subjected to recording is switched back through the switchback path 102, such that the medium 12 enters the reversing path 103 from a trailing edge thereof and is reversed, and then the medium 12 is fed toward the liquid ejecting head 25 again. Then, the liquid ejecting head 25 performs recording on a second surface of the medium 12 that is opposite to the first surface, thereby performing the double-sided recording on the medium 12. The medium 12 subjected to single-sided printing or double-sided printing by the liquid ejecting head 25 is discharged to a discharge portion 104 through the discharge path 101 or is transported to the intermediate device 15.

As illustrated in FIG. 1, the intermediate device 15 includes the reversing processing section 200 that reverses the recorded medium 12 transported from the recording device 13. The reversing processing section 200 includes a lead-in path 201, a first switchback path 202, a second switchback path 203, a first joining path 204, a second joining path 205, and a lead-out path 206. The reversing processing section 200 includes a plurality of transport roller pairs 19 (only one of them is illustrated in the drawing) that transport the medium 12 along each of the paths 201 to 206, and a flap (not illustrated) that guides the medium 12 at a branch point of each of the paths 201 to 203 to one transport destination. After the medium 12 passes through the lead-in path 201, the transport destination of the medium 12 is switched between the first switchback path 202 and the second switchback path 203 by the flap.

The medium 12 switched back through the first switchback path 202 is reversed on the first joining path 204 and then transported to the lead-out path 206. On the other hand, the medium 12 switched back through the second switchback path 203 is reversed on the second joining path 205 and then transported to the lead-out path 206. The reversed medium 12 is fed from the intermediate device 15 to the post-processing device 14 through the lead-out path 206, in a state where the surface that has just been subjected to recording in the recording device 13 faces downward. Further, the medium 12 is dried while being transported inside the intermediate device 15, and the medium 12 whose wrinkling or the like caused by moisture in the ink attached to the medium 12 is suppressed is fed to the post-processing device 14.

Next, a configuration of the post-processing device 14 will be described with reference to FIGS. 1 to 3. Note that, in FIGS. 2 and 3, the discharge stacker 35 is omitted. As illustrated in FIG. 1, the medium 12 reversed in the intermediate device 15 is transported to the inside of a case 14A of the post-processing device 14. The medium 12 transported to the inside of the case 14A is transported by the transport mechanism 30 described above, and then is nearly horizontally discharged to a space (processing region) above the processing tray 32. That is, when viewed from the processing tray 32, the medium 12 is nearly horizontally transported from the transport mechanism 30 to the space above the processing tray 32. In the transport mechanism 30, a sensor 34 that detects the presence or absence of the medium 12 is provided on a transport path between the transport roller pair 19A and the transport roller pair 31. The sensor 34 detects a leading edge and a trailing edge of the medium 12 in the transport direction Y0. The control portion 110 detects a timing at which the trailing edge is separated from the transport roller pair 31 of the transport mechanism 30 at a detection position where the sensor 34 detects the trailing edge of the medium 12. Once the trailing edge of the medium 12 is separated from the transport roller pair 31, the control portion 110 starts a registration control for loading the medium 12 in a registered state on the processing tray 32.

Figure 2:
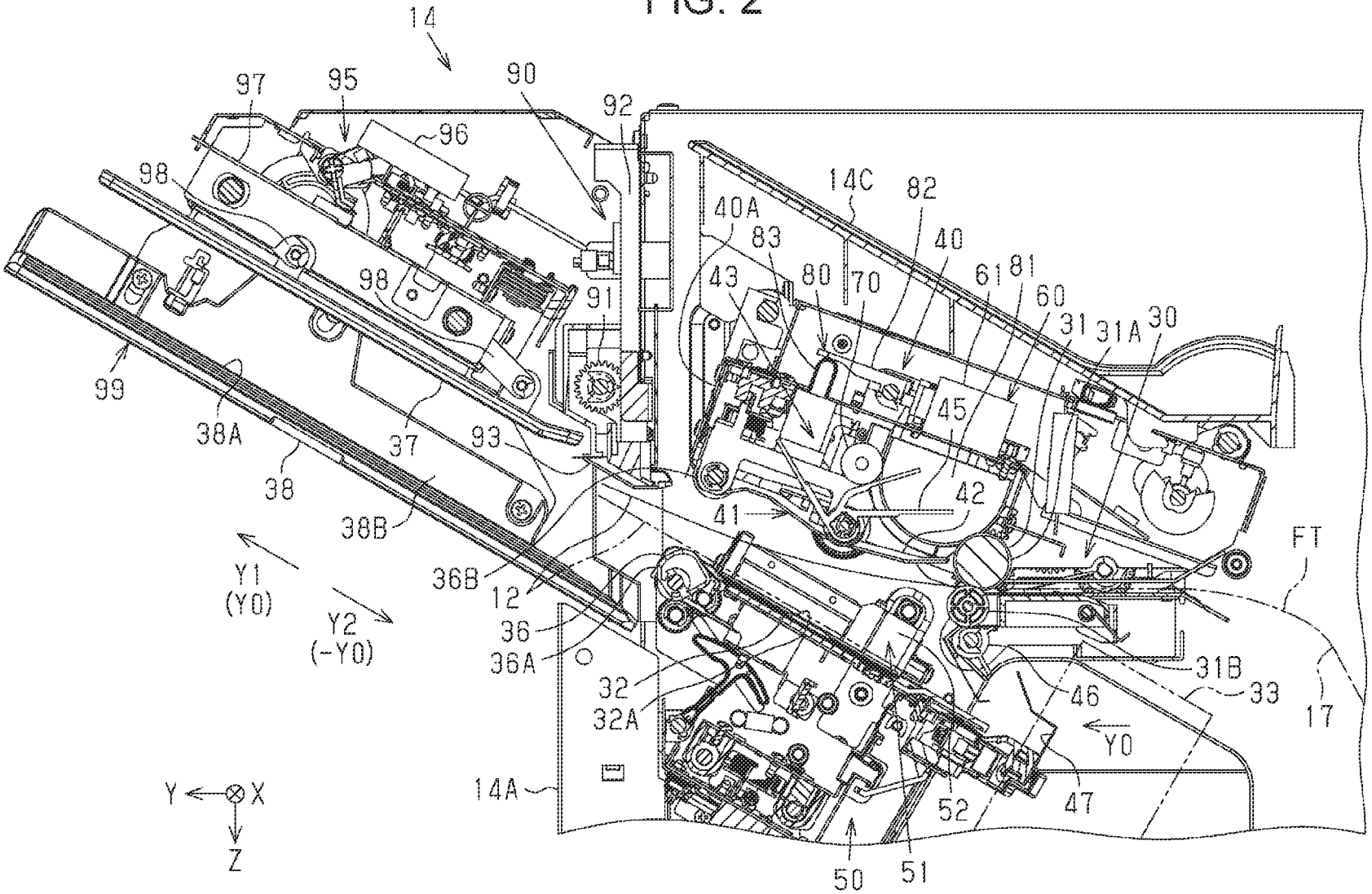
FIG. 2 is a front cross-sectional view illustrating main portions of the post-processing device.

As illustrated in FIG. 2, the post-processing device 14 includes the transport mechanism 30, the processing tray 32, a receiving mechanism 41, a feeding mechanism 43, a registration mechanism 51, the discharge mechanism 36, a pressing-down mechanism 90, a guide mechanism 95, and a medium support mechanism 99.

The transport mechanism 30 includes the above-described transport roller pair 31 provided at a downstream end portion in the transport direction Y0. The transport roller pair 31 includes a driving roller 31A and a driven roller 31B. The medium 12 is nearly horizontally transported from the transport roller pair 31 to the processing region above the processing tray 32.

The post-processing device 14 includes a paddle unit 40 positioned on the upper side and a registration unit 50 positioned on the lower side while having the transport path through which the medium 12 is nearly horizontally transported from the transport mechanism 30 interposed therebetween in the vertical direction Z. The processing tray 32 is obliquely fixed to an upper end portion of the registration unit 50.

As described above, the post-processing device 14 includes the processing tray 32 on which the medium 12 subjected to recording by the recording portion 24 is loaded, and the first paddle 45 which is an example of a transportation member provided above the processing tray 32 and rotating to transport the medium 12 toward the upstream in the transport direction Y0. Specifically, the paddle unit 40 that rotatably supports the first paddle 45 is disposed above the processing tray 32.

Note that, as illustrated in FIG. 2, the post-processing device 14 includes a discharge tray 14C through which a recorded medium transported through a transport path other than a transport path FT through which the medium 12 constituting the medium bundle 12B is transported is discharged. The discharge tray 14C is positioned above the paddle unit 40, and is disposed at a height at which the user can easily take the medium. For example, a medium 12 on which an image that the recording device 13 received by fax is recorded is discharged to the discharge tray 14C. An increase in size of the paddle unit 40 in the height direction may lead to raising of a height position of the discharge tray 14C and an increase in size of the post-processing device 14 in the height direction.

The processing tray 32 illustrated in FIG. 2 has a loading surface 32A on which the medium 12 is loaded. The loading surface 32A is an inclined surface of which an upstream end in the transport direction Y0 is positioned on a level lower than that of a downstream end in the vertical direction Z. The processing tray 32 has a predetermined width larger than the maximum width of the medium 12 in the width direction X. Note that the transport direction Y0 in which the medium bundle 12B is discharged from the loading surface 32A is referred to as a first transport direction Y1, and a direction opposite to the first transport direction Y1 is referred to as a second transport direction Y2 (−Y0) according to the inclination of the loading surface 32A of the processing tray 32. That is, the first transport direction Y1 is the same as the transport direction Y0 of the medium 12 on the loading surface 32A, and the second transport direction Y2 is the same as the counter-transport direction −Y0 which is a direction opposite to the transport direction Y0 of the medium 12 on the loading surface 32A.

The paddle unit 40 includes the receiving mechanism 41, a part of the feeding mechanism 43, and a paddle unit frame 40A that supports them. The receiving mechanism 41 guides the medium 12 downward so that the medium 12 nearly horizontally transported from the transport roller pair 31 can be received on the processing tray 32 that is inclined with respect to a horizontal plane. The receiving mechanism 41 includes a rotary variable guide 42.

The feeding mechanism 43 has a function of feeding, in the second transport direction Y2 along the inclined loading surface 32A, the medium 12 guided by the receiving mechanism 41 toward the processing tray 32. The feeding mechanism 43 includes the above-described first paddle 45 having a large diameter, and a second paddle 46 having a small diameter, the first paddle 45 and the second paddle 46 being provided above the processing tray 32. The first paddle 45 having a large diameter is at a position corresponding to the upstream in the second transport direction Y2 above the loading surface 32A of the processing tray 32. The second paddle 46 having a small diameter is at a position corresponding to the downstream in the second transport direction Y2 above the loading surface 32A of the processing tray 32. The first paddle 45 is installed in the paddle unit 40. Note that the second paddle 46 is rotatably supported at a position under the transport roller pair 31 by a frame other than the paddle unit 40.

The variable guide 42 illustrated in FIG. 2 rotates around a downstream end portion in the transport direction Y0 within a predetermined angle range. The variable guide 42 rotates between a wait position illustrated in FIG. 2 and an operation position (not illustrated) that is reached when the variable guide 42 rotates from the wait position by a predetermined angle in a clockwise direction in FIG. 2. A distal end of the variable guide 42 at the wait position is positioned nearly above a transport port of the transport roller pair 31. Further, the variable guide 42 is positioned at a portion corresponding to the center of the width of the paddle unit 40 (see FIG. 3). The variable guide 42 rotates from the wait position toward the operation position in the clockwise direction in FIG. 2 to perform an operation of hitting, in a downward direction, a portion corresponding to the center of the width of the medium 12 nearly horizontally transported from the transport roller pair 31 at a predetermined transport speed and indicated by a solid line in FIG. 2. As the variable guide 42 hits the medium 12 in the downward direction, the path of the medium 12 is changed to be directed to a direction along the loading surface 32A of the processing tray 32, and the medium 12 is received on the processing tray 32. Note that the number of variable guides 42 may be plural, and the plurality of guides 42 may be provided at different position in the width direction X.

As illustrated in FIG. 2, the paddle unit 40 formed by mounting the variable guide 42 included in the receiving mechanism 41 and a driving mechanism 80 thereof, and the first paddle 45 included in the feeding mechanism 43 and a driving mechanism 60 thereof are mounted on the paddle unit frame 40A. The first paddle 45 rotates by being driven by the driving mechanism 60. The variable guide 42 rotates by being driven by the driving mechanism 80. The cross section of the paddle unit frame 40A has a reverse U shape having an opening that is open downward when viewed from the side as illustrated in FIG. 2, and viewed from the front as illustrated in FIG. 3. The driving mechanism 60 includes an electric motor 61 which is a driving source of the first paddle 45. The driving mechanism 80 includes an electric motor 81 which is a driving source of the variable guide 42.

The first paddle 45 is rotatably supported at a lower portion of the paddle unit frame 40A. The upper side of the first paddle 45 is covered by an upper surface portion 40B of the paddle unit frame 40A. The paddle unit frame 40A has the upper surface portion 40B covering the upper side of the first paddle 45 which is an example of the transportation member, and thus forms an upper member. Note that the upper member is a member having at least a part of the upper surface portion 40B covering the upper side of the first paddle 45. It is not necessary that the upper surface portion 40B is the uppermost surface portion of the paddle unit frame 40A.

Further, as illustrated in FIG. 2, the driving mechanism 80 of the variable guide 42 includes the electric motor 81, a driving lever 82 driven by a driving force of the electric motor 81, and a driven portion 83 that is displaced by being pressed downward by the driving lever 82. The driven portion 83 is urged upward by a spring (not illustrated) and is displaced downward by being pressed by the driving lever 82. When the driven portion 83 is displaced downward, the variable guide 42 rotates up to the operation position that is positioned obliquely below the wait position illustrated in FIG. 2 at a predetermined angle. Once the driving lever 82 returns to a position where the driving lever 82 does not press the driven portion 83, the variable guide 42 rotates from the operation position to the wait position by an urging force of the spring. The medium 12 transported from the transport roller pair 31 is hit downward by such reciprocal rotation of the variable guide 42.

Note that the control portion 110 drives the electric motor 81 once the driving roller 31A rotates by a rotation amount enough for the trailing edge of the medium 12 to pass through a nip position of the transport roller pair 31 after the sensor 34 (see FIG. 1) detects the trailing edge of the medium 12. By doing so, the variable guide 42 rotates from the wait position to the operation position at a timing at which the trailing edge of the medium 12 is separated from the transport roller pair 31. The medium 12 nearly horizontally transported to the processing region above the processing tray 32 is hit downward at a timing at which the trailing edge of the medium 12 escapes from the transport roller pair 31, and the transport path of the medium 12 is changed to be directed to the direction along the processing tray 32.

Further, the first paddle 45 starts to rotate at a timing at which the variable guide 42 hits the medium 12 downward. As the variable guide 42 hits the medium 12 and the first paddle 45 rotates, the medium 12 is guided to the processing tray 32. That is, the first paddle 45 also has a function of rotating to make the medium 12 be received on the loading surface 32A together with the variable guide 42. The first paddle 45 can rotate around a rotation shaft 67 to transport the medium 12 in the second transport direction Y2. The first paddle 45 and the second paddle 46 come into contact with the medium 12 at different positions in the second transport direction Y2 while rotating to transport the medium 12 in the second transport direction Y2. The first paddle 45 and the second paddle 46 may feed the medium 12 in the second transport direction Y2 at the same feeding speed. The first paddle 45 having a large diameter may feed the medium 12 by a large feeding amount, and the second paddle 46 having a small diameter may feed the medium 12 by a small feeding amount.

As illustrated in FIG. 2, an abutting portion 47 extends upward at a downstream end portion of the processing tray 32 in the second transport direction Y2. The abutting portion 47 extends in a predetermined shape from the end portion of the processing tray 32, and has a surface portion orthogonal to the loading surface 32A when viewed from the side in FIG. 2. The paddles 45 and 46 feed the medium 12 on the processing tray 32 until the medium 12 abuts the abutting portion 47.

A trailing edge 12*r* of the medium 12 fed by the paddles 45 and 46 in the second transport direction Y2 abuts the abutting portion 47, and as a result, the medium 12 is registered in the transport direction Y0 based on the abutting position. A plurality of abutting portions 47 are provided at intervals in the width direction X. The interval between the plurality of abutting portions 47 is set so that a medium 12 having the minimum width can abut a plurality of portions.

The registration mechanism 51 illustrated in FIG. 2 has a function of registering the medium 12 on the processing tray 32 in the width direction X. The registration mechanism 51 includes a pair of registration members 52 that can move in the width direction X along the loading surface 32A of the processing tray 32. The registration mechanism 51 includes two electric motors (not illustrated) which are driving sources for individually driving the pair of registration members 52. The pair of registration members 52 hits opposite side edges of the medium 12 once or multiple times at a timing at which the first paddle 45 that intermittently comes into contact with the medium 12 is separated from the medium 12, thereby performing registration for aligning the medium 12 in the width direction X. In this way, the medium 12 is registered in two directions, the transport direction Y0 and the width direction X, on the processing tray 32.

The media 12 are sequentially loaded on the processing tray 32. The plurality of media 12 are registered in a state where the edges thereof are aligned with each other on the processing tray 32 to form the medium bundle 12B. Once the number of media 12 loaded on the processing tray 32 reaches a target number, the post-processing mechanism 33 performs post-processing on the medium bundle 12B on the processing tray 32. The post-processing mechanism 33 in this example is, for example, a stapling mechanism, and can move in the width direction X. The post-processing mechanism 33 moves in the width direction X as necessary, and performs stapling processing on one or more portions of an edge of the medium bundle 12B.

The discharge mechanism 36 illustrated in FIG. 2 is provided at a downstream end portion of the processing tray 32 in the transport direction Y0, and discharges the processed medium bundle 12B from the processing tray 32 toward the discharge stacker 35. The discharge mechanism 36 is, for example, a roller discharge type. The discharge mechanism 36 includes a roller pair including a driving roller 36A and a driven roller 36B that can nip the medium bundle 12B on the processing tray 32. In this example, the driven roller 36B is pivotally supported by a proximal end portion of the variable guide 42. The driven roller 36B moves between a separation position illustrated in FIG. 2 separated from the driving roller 36A, and a nip position (not illustrated) at which the medium bundle 12B can be nipped between the driven roller 36B and the driving roller 36A. The movement of the driven roller 36B between the nip position and the separation position is performed as the paddle unit 40 rotates around a rotation support point (not illustrated) to change its posture. The driven roller 36B is urged by a spring (not illustrated) so as to approach the driving roller 36A. Note that the discharge mechanism 36 is not limited to the roller transport type, and may be a push type mechanism including a pusher that pushes the medium bundle 12B on the processing tray 32 from the processing tray 32.

The guide mechanism 95 including the guide member 37 is provided at a position above the discharge stacker 35 (see FIG. 1). The guide mechanism 95 guides the medium bundle 12B discharged from the processing tray 32 by the discharge mechanism 36 by using the guide member 37 so that the medium bundle 12B does not move upward. The guide mechanism 95 includes an electric motor 96 which is a driving source and a driving mechanism 97. Two output shafts of the driving mechanism 97 are coupled to the guide member 37 through an arm 98. The electric motor 96 drives the guide member 37, such that the position of the guide member 37 is adjusted to change an interval between the medium support member 38 and the guide member 37. The position of the guide member 37 may be adjusted according to the thickness of the medium bundle 12B or the wrinkling amount of the medium bundle 12B.

Further, the pressing-down mechanism 90 is provided at a position between the processing tray 32 and the guide member 37 in the transport direction Y0. The pressing-down mechanism 90 includes a driving source (not illustrated), a pinion 91 that rotates by a driving force of the driving source, a rack member 92 engaged with the pinion 91, and a pressing member 93 fixed to a lower end of the rack member 92. In the pressing-down mechanism 90, the pressing member 93 presses down a trailing edge portion of the discharged medium bundle 12B to prevent a situation in which the trailing edge portion of the medium bundle 12B is caught to a portion in the vicinity of the driving roller 36A and is thus not dropped onto the discharge stacker 35.

Further, the medium support mechanism 99 includes a pair of medium support members 38 (only one of them is illustrated in FIG. 2) arranged at a position between the guide member 37 and the discharge stacker 35 (see FIG. 1). The pair of medium support members 38 (only one of them is illustrated in FIG. 2) is positioned above the discharge stacker 35 (see FIG. 1), and is provided so as to be movable in the width direction X. The pair of medium support members 38 moves, in the width direction X, between a holding position at which the medium bundle 12B can be held on a pair of support surfaces 38A, and a retreat position at which the medium bundle 12B is separated in the width direction X so that the medium bundle 12B cannot be held on the pair of support surface 38A. The pair of medium support members 38 has the support surface 38A that supports a lower surface of the medium bundle 12B, and a guide surface 38B that guides a side edge of the medium bundle 12B. In a state where the pair of medium support members 38 is positioned at the holding position, a leading edge portion of the medium 12 on the processing tray 32 is supported by the pair of support surfaces 38A, and the side edge of the medium 12 is guided by the pair of guide surfaces 38B, such that the misalignment of the medium bundle 12B in the width direction X is within an allowable range.

The pair of medium support members 38 temporarily supports opposite end portions of the medium bundle 12B in the width direction X in a process in which the medium bundle 12B is discharged from the processing tray 32. As the pair of medium support members 38 separates the medium bundle 12B from the holding position at which the medium bundle 12B can be held in the width direction X, the medium bundle 12B drops onto the discharge stacker 35. The medium support mechanism 99 suppresses a leading edge portion of the medium bundle 12B that is being discharged from hanging down. The medium support mechanism 99 prevents a situation in which the hanging leading edge portion of the medium bundle 12B come into contact with the discharge stacker 35 in a discharge process, are drawn downward, and are bent.

Next, a driving system of the first paddle 45 of the paddle unit 40 will be described with reference to FIGS. 3 to 5.

Figure 3:
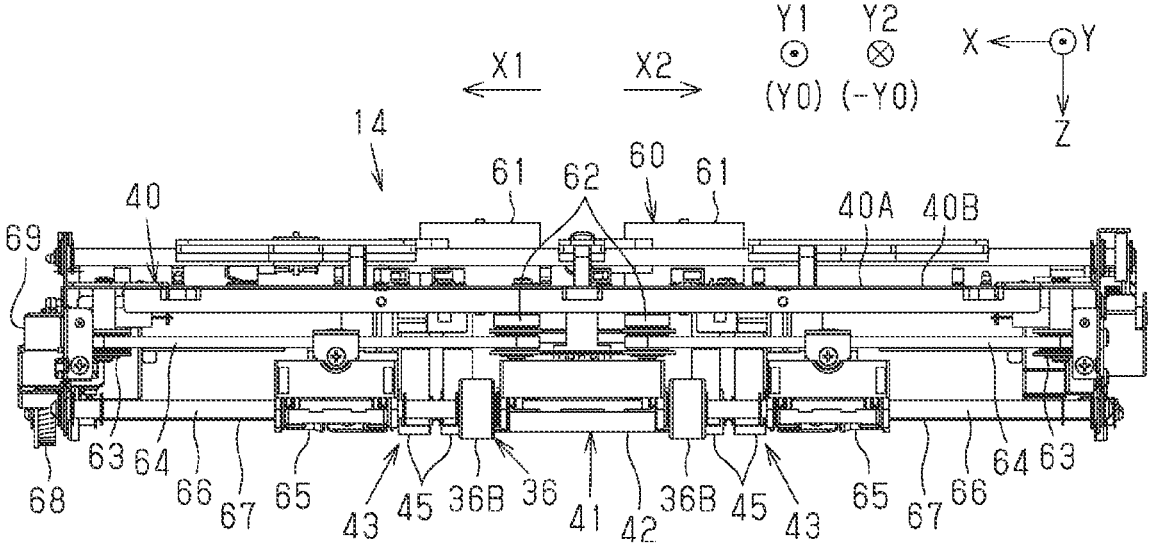
FIG. 3 is a front view illustrating a paddle unit of the post-processing device.

As illustrated in FIG. 3, the driving mechanism 60 of the first paddle 45 includes a pair of electric motors 61 (also see FIG. 2) installed on an upper surface of the paddle unit frame 40A. A set of the first paddles 45 includes a pair of first paddles 45 adjacent to each other in the width direction X, and two sets of the first paddles 45 are provided at two positions separate from each other while having a central portion of the unit interposed therebetween in the width direction X. That is, two sets of the first paddles 45 are arranged at two positions separate from each other while having the central portion of the unit interposed therebetween in the width direction X. The pair of electric motors 61 individually drives each of two sets of the first paddles 45 each including a pair of first paddles 45.

Two sets of pulleys 62 and 63 are provided at different positions in the width direction X below the upper surface portion 40B of the paddle unit frame 40A. The pulleys 62 of each set of the pulleys 62 and 63 are driving pulleys 62 that rotate by a driving force of the electric motor 61, and the pulleys 63 positioned at opposite end portions of the paddle unit frame 40A in the width direction X are driven pulleys. A timing belt 64 is wound around each set of the pulleys 62 and 63. As illustrated in FIGS. 3 and 4, a movable member 65 is fixed to each of a pair of left and right timing belts 64. A pair of left and right movable members 65 is provided so as to be movable by about a half region in the width direction X along a pair of left and right guide shafts 66, respectively. Two sets of the first paddles 45 can move by each movement range in the width direction X together with the movable members 65. When one of two sets of the first paddles 45 moves in the first direction X1, the other one moves in the second direction X2, and when one of two sets of the first paddles 45 moves in the second direction X2, the other one moves in the first direction X1. Therefore, two sets of the first paddles 45 change their positions in the width direction X according to the width of the medium 12, and apply a feeding force for feeding the medium 12 to two appropriate positions corresponding to the width of the medium 12 in the second transport direction Y2.

Figure 4:
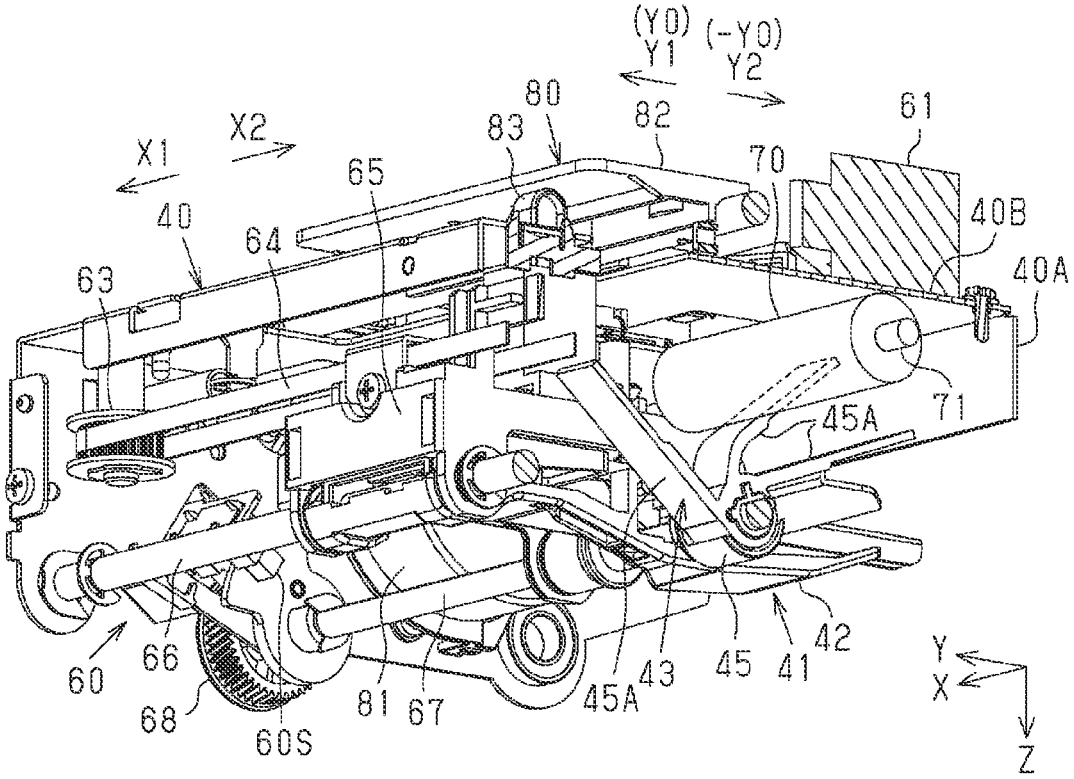
FIG. 4 is a perspective view illustrating main portions of the paddle unit of the post-processing device.

Further, as illustrated in FIGS. 3 and 4, both of two sets of the first paddles 45 are attached to one rotation shaft 67 extending in the width direction X. A gear 68 is fixed to one end portion of the rotation shaft 67 that protrudes from a side portion of the paddle unit frame 40A. An electric motor 69 that outputs a driving force for rotating the gear 68 is installed at the side portion of the paddle unit frame 40A. As the electric motor 69 is driven, two sets of the first paddles 45 rotate in a direction in which the medium 12 on the processing tray 32 can be fed in the second transport direction Y2.

Two sets of the first paddles 45 illustrated in FIGS. 3 and 4 are engaged in a state where the first paddles 45 can move in the width direction X with respect to the rotation shaft 67, and can rotate integrally with the rotation shaft 67. Two sets of the first paddles 45 can move to positions to change an interval therebetween in a state where two sets of the first paddles 45 are spaced apart from each other in the width direction X. The driving of the electric motors 61 and 69 is controlled by the control portion 110. Further, as illustrated in FIG. 4, the paddle unit 40 includes a sensor 60S that detects a rotational position of the rotation shaft 67. The control portion 110 arranges the first paddle 45 so as to be in a wait posture illustrated in FIGS. 2 and 4 based on a detection signal of the sensor 60S. The wait posture of the first paddle 45 refers to a rotation angle of the first paddle 45 in a wait period which is a period except for a feeding operation period in which the medium 12 on the processing tray 32 is fed.

Figure 5:
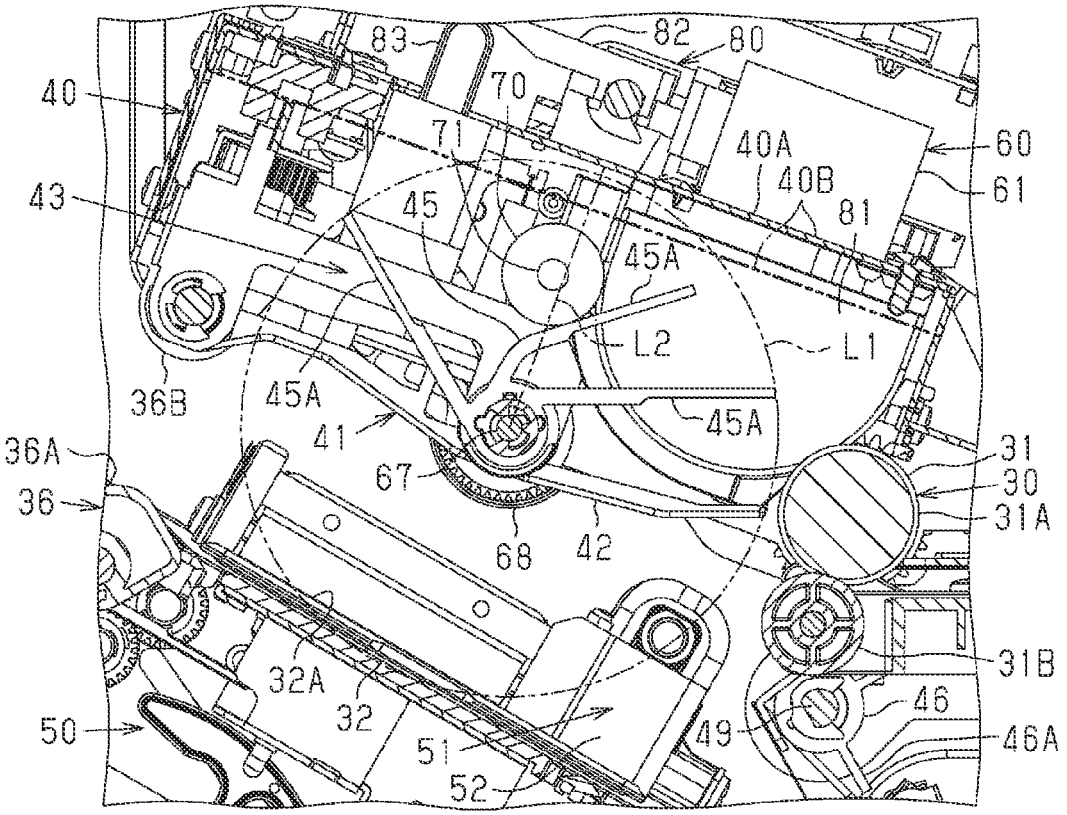
FIG. 5 is a side cross-sectional view illustrating the periphery of the paddle unit of the post-processing device.

As illustrated in FIGS. 4 and 5, the paddle unit 40 includes a roller 70 which is an example of a rotating body provided above the rotation shaft 67 of the first paddle 45. The roller 70 is, for example, a roll. The roller 70 is rotatably supported by a support shaft 71 which is an example of a shaft extending along a rotation shaft line thereof. A shaft line direction of the support shaft 71 is parallel to a shaft line direction of the rotation shaft 67 of the first paddle 45. The roller 70 is a driven roller that rotates when an external force is applied.

The paddle unit frame 40A which is an example of the upper member is arranged above the roller 70. Specifically, the upper surface portion 40B which is a part of the paddle unit frame 40A is positioned above the roller 70. That is, the roller 70 is arranged below the upper surface portion 40B of the paddle unit frame 40A. Further, the roller 70 is arranged above the rotation shaft 67 of the first paddle 45. As a result, the roller 70 is positioned between the rotation shaft 67 and the upper surface portion 40B in the vertical direction Z. The roller 70 is arranged while being spaced apart from the upper surface portion 40B at a predetermined interval. Further, the roller 70 has a length in the width direction long enough to come into contact with the first paddle 45 even when the first paddle 45 moves in the width direction X. Therefore, the first paddle 45 comes into contact with the roller 70 at the time of rotating even when the position thereof in the width direction X is changed according to the width of the medium 12.

Next, a characteristic configuration related to the first paddle 45 and the roller 70 will be described with reference to FIG. 5.

The first paddle 45 includes a plurality of blades 45A having a length long enough to reach the loading surface 32A of the processing tray 32. The plurality of blades 45A are arranged at equal intervals within a deviated region corresponding to about ¼ (about 90 degrees) to about a half (about 180 degrees) of one round (360 degrees) around the rotation shaft 67. The interval between the plurality of blades 45A is, for example, a predetermined angle within a range of 10 to 90 degrees. In the example illustrated in FIG. 5, the number of blades 45A is three, and three blades 45A are arranged at equiangular intervals such as about 60 degrees in a region corresponding to about ⅔ (about 120 degrees) of one round around the rotation shaft 67.

Therefore, the posture of the first paddle 45 may be switched between a feeding posture, in which a feeding operation in which any one blade 45A comes into contact with the loading surface 32A or the medium 12 on the loading surface 32A can be performed, and a non-feeding posture in which no blade 45A comes into contact with the loading surface 32A or the medium 12 on the loading surface 32A. Note that the wait posture illustrated in FIG. 5 is a posture with a rotation angle predetermined for waiting among non-feeding postures. In the example illustrated in FIG. 5, in the wait posture, all blades 45A face upward from the horizontal, but it is sufficient that at least one of the blades 45A faces upward from the horizontal.

A circle indicated by a line with alternating long and two short dashes in FIG. 5 indicates a rotation locus L1 of distal tips of the blades 45A of the first paddle 45. However, the rotation locus L1 indicates a rotation locus when it is assumed that there is no roller 70.

The roller 70 is positioned within the rotation locus L1 of the first paddle 45. In the example illustrated in FIG. 5, the entire roller 70 is positioned within the rotation locus L1 of the first paddle 45. However, it is sufficient that at least a portion of the roller 70 is positioned within the rotation locus L1 of the first paddle 45.

Further, in a side view of the first paddle 45 when viewed from an axial direction of the rotation shaft 67, at least portions of the roller 70 and the paddle unit frame 40A are positioned with the rotation locus L1 of the first paddle 45. In the example illustrated in FIG. 5, the upper surface portion 40B of the paddle unit frame 40A is not positioned within the rotation locus L1 of the first paddle 45. In this case, it is possible to secure an arrangement space for arranging components constituting the driving mechanisms 60 and 80 between the roller 70 and the upper surface portion 40B. Therefore, it is possible to reduce the size of the paddle unit 40 in the height direction.

Like the upper surface portion 40B indicated by a line with alternating long and two short dashes in FIG. 5, the upper surface portion 40B may be partially positioned within the rotation locus L1 of the first paddle 45. Even in this case, the roller 70 is arranged between the rotation shaft 67 and the upper surface portion 40B. With this configuration, it is possible to reduce the size of the paddle unit 40 in the height direction. Note that the height direction of the paddle unit 40 may be any one of the vertical direction Z and a direction perpendicular to the loading surface 32A of the processing tray 32.

Meanwhile, when there is no roller 70 in a configuration in which a portion of the paddle unit frame 40A is positioned within the rotation locus L1 of the first paddle 45 which is an example of the transportation member, it is possible to reduce the size of the paddle unit 40 in the height direction. However, since the first paddle 45 comes into contact with the paddle unit frame 40A each time the first paddle 45 rotates, the blades 45A wear. Therefore, a configuration, in which the paddle unit frame 40A may be arranged at a height position at which the blades 45A do not come into contact with the upper surface portion 40B even when the first paddle 45 rotates, can be considered. However, with such a configuration, since the size of the paddle unit 40 in the height direction increases, the wear of the first paddle 45 can be avoided, but the size of the post-processing device 14 in the height direction increases.

Therefore, in the present embodiment, the roller 70 is arranged within the rotation locus L1 of the first paddle 45, and the first paddle 45 comes into contact with the roller 70, such that the wear of the blades 45A is reduced. Further, when the roller 70 is arranged within the rotation locus L1 of the first paddle 45, the blades 45A are bent when coming into contact with the roller 70. Therefore, the actual rotation locus of the first paddle 45 is smaller than the rotation locus L1 by the size of a region above the roller 70. The region above the roller 70 excluded from the rotation locus can be used to lower the arrangement space for the components of the driving mechanisms 60 and 80, or the arrangement position of the upper surface portion 40B. With any one of these configurations, it is possible to reduce the size of the paddle unit 40 in the height direction.

Further, the roller 70 is positioned above the rotation shaft 67 of the first paddle 45. Therefore, the first paddle 45 comes into contact with the roller 70 when the blades 45A are at a posture angle at which the blades 45A face upward from the horizontal at the time of rotating once from the wait posture.

The roller 70 is provided, between the rotation shaft 67 and the paddle unit frame 40A, at a position where a distance between the rotation shaft 67 and the paddle unit frame 40A is shortest. In other words, in the side view illustrated in FIG. 5, the roller 70 is provided at a position on a virtual line L2 coupling two positions, corresponding to the shortest distance between the rotation shaft 67 and the paddle unit frame 40A. Note that, when being arranged at the position where the distance is shortest, it is sufficient that the roller 70 is at least partially positioned on the virtual line L2.

A friction coefficient between the roller 70 and the support shaft 71 is smaller than a friction coefficient between the roller 70 and the first paddle 45. The first paddle 45 in this example is formed of, for example, synthetic rubber. Further, at least a surface portion of the roller 70 is formed of a synthetic resin. In this example, the entire roller 70 is formed of a synthetic resin. That is, an outer circumferential surface of the roller 70 and an inner circumferential surface of the roller 70 into which the support shaft 71 is inserted are formed of a synthetic resin. In addition, the support shaft 71 is formed of a synthetic resin. Therefore, the friction coefficient between the roller 70 and the support shaft 71 is a friction coefficient between synthetic resins. Further, the friction coefficient between the roller 70 and the first paddle 45 is a friction coefficient between a synthetic resin and rubber. The friction coefficient between a synthetic resin and rubber is larger than the friction coefficient between synthetic resins. Therefore, in the present embodiment, the friction coefficient between the roller 70 and the support shaft 71 is smaller than the friction coefficient between the roller 70 and the first paddle 45.

Further, the second paddle 46 includes a plurality of blades 46A having a length long enough to reach the loading surface 32A. The second paddle 46 has a smaller diameter than that of the first paddle 45, but has substantially the same shape as that of the first paddle 45. The second paddle 46 is fixed to a rotation shaft 49 extending in the width direction and provided at a position above the processing tray 32 and on the downstream of the rotation shaft 67 in the second transport direction Y2. A pair of second paddles 46 is arranged while being spaced apart from each other at a second interval smaller than the interval between the pair of first paddles 45 in the width direction X. The pair of second paddles 46 is positioned so as to be able to come into contact even with a small medium 12 at two portions in the width direction X. Note that the pair of second paddles 46 may be movably provided in the width direction X according to the width of the medium 12, similarly to the first paddle 45. Alternatively, a configuration, in which two sets of the first paddles 45 do not move in the width direction X, and are positioned so as to be able to come into contact even with a small medium 12 at two portions in the width direction X, is also possible.

Figure 6:
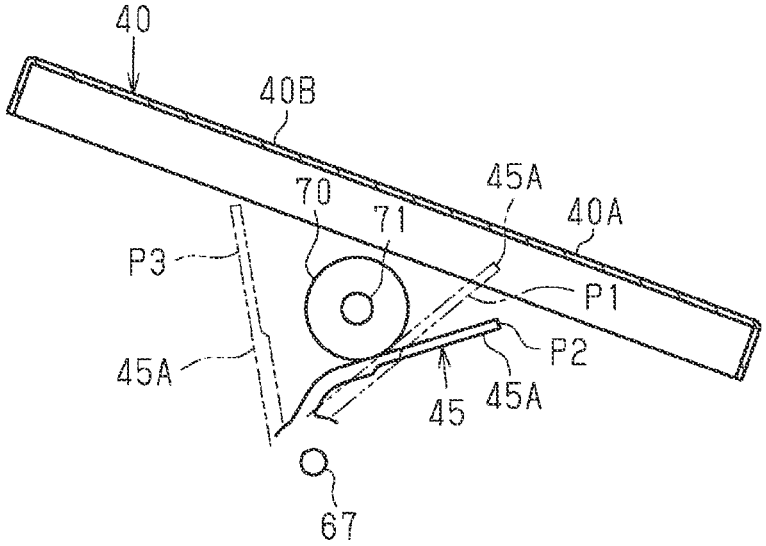
FIG. 6 is a schematic side view illustrating a relationship between a first paddle and a roller.

FIG. 6 illustrates a movement locus of the blade 45A that comes into contact with the roller 70 when the first paddle 45 rotates. The first paddle 45 rotates in a counterclockwise direction in FIG. 6. Here, the focus is on one of the plurality of blades 45A of the first paddle 45. When the blade 45A is positioned at a first position P1, the blade 45A comes into contact with the outer circumferential surface of the roller 70 in a state where the blade 45A is straight. Then, when the blade 45A moves to a second position P2, the blade 45A is bent at a portion that comes into contact with the outer circumferential surface of the roller 70. Therefore, a distal end of the blade 45A becomes distant from the upper surface portion 40B of the paddle unit frame 40A. That is, the position of the distal end of the blade 45A is more distant from below the upper surface portion 40B of the paddle unit frame 40A as compared with the position of the distal end of the straight blade 45A in the rotation posture at the second position P2 in the configuration that does not include the roller 70. In addition, in a process in which the blade 45A moves to a third position P3, the blade 45A passes below the roller 70 while coming into contact with the outer circumferential surface of the roller 70 and being deformed. The blade 45A that passed below the roller 70 is restored to the straight state with its elastic force thereof at the third position P3. In the process of the movement from the first position P1 to the third position P3, the distal end of the blade 45A draws a locus below the rotation locus L1 in a region above the rotation locus L1 illustrated in FIG. 5.

In the present embodiment, the friction coefficient between the roller 70 and the support shaft 71 is smaller than the friction coefficient between the roller 70 and the first paddle 45. Therefore, in a process in which the blade 45A of the first paddle 45 moves from the first position P1 at which the blade 45A comes into contact with the outer circumferential surface of the roller 70 to the third position P3, as the roller 70 rotates in a state where the blade 45A is in contact with the outer circumferential surface of the roller 70, the blade 45A passes below the roller 70 while being bent. In this process, the blade 45A and the outer circumferential surface of the roller 70 do not slide with respect to each other, and thus the wear of the blade 45A is suppressed.

Next, a transport operation of the first paddle 45 will be described with reference to FIGS. 7 to 9. The first paddle 45 rotates up to the position for the wait posture each time the medium bundle 12B is formed on the processing tray 32. In the wait posture, all of the plurality of blades 45A of the first paddle 45 are separated from the medium bundle 12B. In a state where the first paddle 45 is in the wait posture, the rollers 36A and 36B of the discharge mechanism 36 nip the medium bundle 12B, and rotate to discharge the medium bundle 12B from the processing tray 32.

Figure 7:
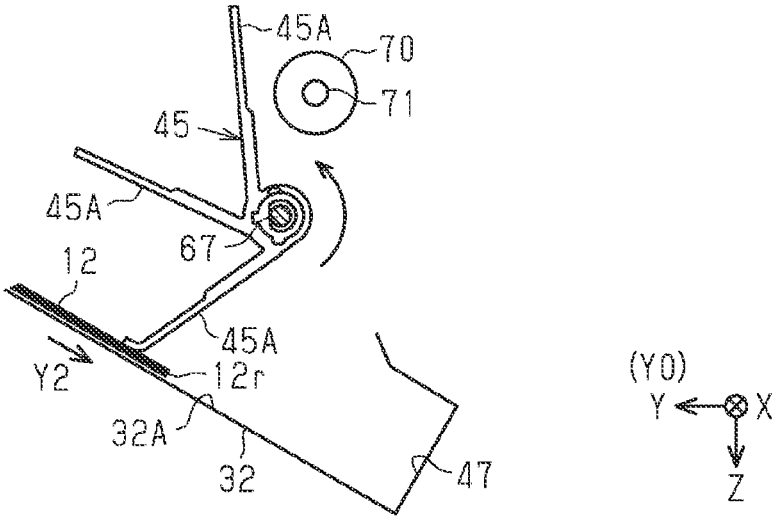
FIG. 7 is a schematic side view for describing a feeding operation of the first paddle.

For example, as illustrated in FIG. 7, when the first medium 12 is received on the processing tray 32, the first paddle 45 starts rotation, and the first blade 45A comes into contact with the medium 12 to transport the medium 12 in the second transport direction Y2.

Figure 8:
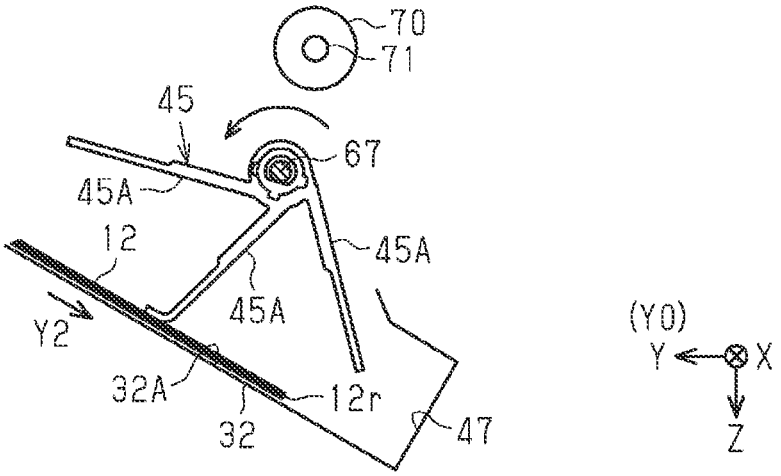
FIG. 8 is a schematic side view for describing the feeding operation of the first paddle.

Next, as illustrated in FIG. 8, the second blade 45A comes into contact with the medium 12 to transport the medium 12 in the second transport direction Y2.

Figure 9:
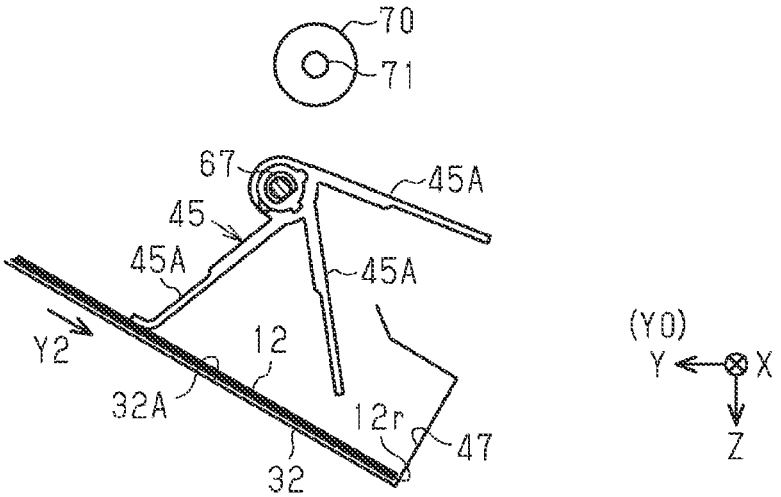
FIG. 9 is a schematic side view for describing the feeding operation of the first paddle.

Then, as illustrated in FIG. 9, the third blade 45A comes into contact with the medium 12 to transport the medium 12 in the second transport direction Y2. The posture of the first paddle 45 when transporting (feeding) the medium 12 illustrated in FIGS. 7 to 9 is a transport posture. The control portion 110 stops the first paddle 45 at a timing at which the leading edge of the medium 12 abuts the abutting portion 47, or a timing slightly later than the timing. The control portion 110 may stop the first paddle 45 in the wait posture in each rotation, or control a stop timing of the first paddle 45 in a state where the last blade 45A comes into contact with the medium 12 on the processing tray 32 and is deformed. The blade 45A pushes the medium 12 in a state where the blade 45A comes into contact with the medium 12 and is deformed. In a state where the first paddle 45 is stopped as described above, the trailing edge 12*r* of the medium 12 on the processing tray 32 abuts the abutting portion 47 and is registered in the second transport direction Y2. Note that the first paddle 45 may rotate multiple times in the transport process.

The first paddle 45 rotates up to the wait posture and is stopped in a state where one of the plurality of blades 45A whose distal end is positioned uppermost comes into contact with the outer circumferential surface of the roller 70 and is bent.

Next, an action of the recording system 11 will be described.

The medium 12 subjected to recording in the recording device 13 is reversed in the intermediate device 15, and then is fed to the post-processing device 14. In the post-processing device 14, the medium 12 is transported to the transport mechanism 30. As illustrated in FIG. 2, the medium 12 passes through the transport mechanism 30 and is transported from the transport roller pair 31 onto the processing tray 32. Here, as the variable guide 42 rotates from the wait position to the operation position, the medium 12 indicated by the solid line in FIG. 2 is hit and dropped downward. As a result, the transport path of the medium 12 is changed to be directed downward. Then, the first paddle 45 waiting at the wait position illustrated in FIGS. 2 and 3 rotates in a counterclockwise direction in the same drawing.

Two sets of left and right first paddles 45 are repositioned so as to be arranged at an interval according to the width of the medium 12 that is a post-processing target. That is, in a case of a first medium 12 whose width is a first width, two sets of left and right first paddles 45 are repositioned to first positions adjacent to the center in the width direction X illustrated in FIGS. 3 and 4. On the other hand, in a case of a second medium 12 whose width is a second width larger than the first width, two sets of left and right first paddles 45 are repositioned to second positions whose interval therebetween is larger than that of the first positions adjacent to the center in the width direction X illustrated in FIGS. 3 and 4.

Before starting rotation, the first paddle 45 is arranged in the wait posture which is a posture in which at least one of the plurality of blades 45A faces upward from the horizontal as illustrated in FIGS. 4 and 5. Here, at least one of the plurality of blades 45A included in the first paddle 45 comes into contact with the outer circumferential surface of the roller 70 and is slightly bent (see FIGS. 4 and 5).

As the first paddle 45 rotates, the medium 12 is pulled in on the loading surface 32A of the processing tray 32 toward the abutting portion 47 in the second transport direction Y2 as illustrated in FIGS. 7 to 9. Further, as the trailing edge 12*r* of the medium 12 fed by the first paddle 45 in the second transport direction Y2 abuts the abutting portion 47, and the medium 12 is registered in the second transport direction Y2. Before the trailing edge 12*r* of the medium 12 abuts the abutting portion 47, the medium 12 is fed in the second transport direction Y2 by the second paddle 46 (see FIGS. 2 and 5) having a diameter smaller than that of the first paddle 45.

The medium 12 is fed at a high speed by the first paddle 45 having a large diameter, and the medium 12 is fed at a speed, that is lower than that can be achieved by the first paddle 45, by the second paddle 46 having a smaller diameter. For example, the first paddle 45 feeds the medium 12 at a high speed up to the middle of a process in which the medium 12 is pulled in before the trailing edge 12*r* of the medium 12 abuts the abutting portion 47, and the second paddle 46 feeds the medium 12 at a low speed from the middle of the process and until the trailing edge 12*r* of the medium 12 abuts the abutting portion 47. Therefore, a registration error caused by rebounding when the trailing edge 12*r* of the medium 12 abuts the abutting portion 47 rarely occurs. Therefore, the medium 12 is registered without being misaligned in the transport direction Y0. Note that, in a process in which the medium 12 is fed by the paddles 45 and 46, a pair of registration members 52 hits opposite ends of the medium 12 to also register the medium 12 in the width direction X.

In a process in which the first paddle 45 rotates, the plurality of blades 45A sequentially come into contact with the outer circumferential surface of the roller 70 and are bent. In this example, a frictional resistance between the blade 45A and the roller 70 is larger than a sliding resistance between the roller 70 and the support shaft 71. Therefore, the blade 45A (the first position P1 in FIG. 6) that comes into contact with the outer circumferential surface of the roller 70 does not slide with respect to the outer circumferential surface of the roller 70, and the roller 70 rotates in a state where the blade 45A is in contact with the outer circumferential surface of the roller 70, such that the blade 45A passes below the roller 70 while being bent (the second position P2 in FIG. 6). In such a process in which the blade 45A passes, the blade 45A and the outer circumferential surface of the roller 70 rarely slip with respect to each other. Therefore, the roller 70 rotates. Then, after the blade 45A passes below the roller 70, the blade 45A is restored to a state where the blade 45A is straight in a radial direction from the bent state with its elastic restoring force.

Next, the same processing is performed also for the next medium 12. That is, the change of the path of the medium 12 transported from the transport roller pair 31, the feeding operation of the first paddle 45, the feeding operation of the second paddle 46, and the registration operation of the registration member 52 in the width direction X are performed. The second and subsequent media 12 are transported in the second transport direction Y2 along an upper surface of the medium 12 already loaded on the loading surface 32A of the processing tray 32 by the first paddle 45 and the second paddle 46. Then, as the trailing edges 12*r* of the media 12 abut the abutting portion 47, the media 12 are registered in the transport direction Y0. In this way, the media 12 are registered in the transport direction Y0 and the width direction X, and loaded on the processing tray 32 one by one.

Once the number of media 12 loaded on the processing tray 32 reaches a target number, the post-processing mechanism 33 moves with respect to the processing tray 32 in the width direction X, and performs stapling processing on the trailing edges 12*r* of the medium bundle 12B on the processing tray 32 at a predetermined position. Once the stapling processing is performed by a designated number of times at a designated position, the medium bundle 12B on the processing tray 32 is nipped by the driving roller 36A and the driven roller 36B. Then, the driving roller 36A is driven in a such a state where the medium bundle 12B is nipped, such that the medium bundle 12B is discharged from the processing tray 32.

In this discharge process, the pressing member 93 and the guide member 37 suppress the medium bundle 12B from moving upward, and the medium bundle 12B is temporarily supported by the medium support member 38. As a result, the leading edge portion of the medium bundle 12B is prevented from hanging down. Therefore, it is possible to prevent the bending of the leading edge portion that easily occurs when the medium bundle 12B is discharged in a state where the leading edge portion of the medium bundle 12B hangs down. Further, as the interval between the pair of medium support members 38 in the width direction X increases, the medium bundle 12B that was temporarily supported drops onto the discharge stacker 35.

In the paddle unit 40 of the present embodiment, in a process in which the blade 45A moves to the first position P1 to the third position P3, the blade 45A is bent to pass below the roller 70, such that a space region in which the blade 45A does not pass is secured above the roller 70. In this example, as illustrated in FIG. 5, the components of the driving mechanisms 60 and 80 are provided in the space region between the roller 70 and the upper surface portion 40B of the paddle unit frame 40A. As a result, the number of components installed above the upper surface portion 40B of the paddle unit frame 40A is decreased, such that it is possible to reduce the size of the paddle unit 40 in the height direction.

Further, the upper surface portion 40B of the paddle unit frame 40A may be lowered to a position indicated by a line with alternating long and two short dashes in FIG. 5, and the upper surface portion 40B indicated by the line with alternating long and two short dashes in FIG. 5 may be arranged within the rotation locus L1 of the blades 45A. With this configuration, it is possible to reduce the size of the paddle unit 40 in the height direction by the amount lowered in the height position of the upper surface portion 40B of the paddle unit frame 40A. Further, since the size of the paddle unit 40 in the height direction is reduced, it is possible to reduce the size of the post-processing device 14 in the height direction.

As specifically described above, according to the first embodiment, the following effects can be exerted.

(1) The post-processing device 14 includes the processing tray 32 on which the medium 12 subjected to recording by the recording portion 24 is loaded, and the first paddle 45 which is an example of the transportation member provided above the processing tray 32 and rotating to transport the medium 12 toward the upstream in the transport direction. In addition, the post-processing device 14 includes the roller 70 which is an example of the rotating body provided above the rotation shaft 67 of the first paddle 45, and the paddle unit frame 40A which is an example of the upper member provided above the roller 70. The roller 70 and the paddle unit frame 40A are positioned within the rotation locus L1 of the first paddle 45. Note that it is sufficient that the paddle unit frame 40A and the roller 70 are at least partially within the rotation locus L1. Accordingly, it is possible to suppress the wear of the first paddle 45, and reduce the size of the post-processing device 14 in the height direction.

(2) The first paddle 45 rotates around the rotation shaft 67 to transport the medium 12. The roller 70 is provided, between the rotation shaft 67 and the paddle unit frame 40A, at a position where the distance between the rotation shaft 67 and the paddle unit frame 40A is shortest. When being arranged at the position where the distance is shortest, it is sufficient that the roller 70 is at least partially positioned on a line indicating the shortest distance. Therefore, as the roller 70 is provided at a position where the first paddle 45 is deformed the most, it is possible to reduce the friction between the first paddle 45 and the roller 70. That is, when a member is arranged at a position where the first paddle 45 is deformed the most at the time of rotation, the roller 70 is used as the member, such that it is possible to reduce the friction between the first paddle 45 and the roller 70 (member).

(3) The friction coefficient between the roller 70 and the support shaft 71 is smaller than the friction coefficient between the roller 70 and the first paddle 45. Therefore, as the roller 70 rotates when the first paddle 45 comes into contact with the roller 70, the sliding of the first paddle 45 and the roller 70 relative to each other is suppressed. As a result, it is possible to suppress the friction caused by the contact between the first paddle 45 and the roller 70.

Second Embodiment

Next, a second embodiment will be described with reference to FIG. 10. Note that the configuration of the rotating body included in the paddle unit 40 is different from that of the first embodiment, and other components of the paddle unit 40 and the components in the recording system 11 and the post-processing device 14 are the same as those of the first embodiment. Therefore, only the configuration of the paddle unit 40 of the present embodiment will be described below.

Figure 10:
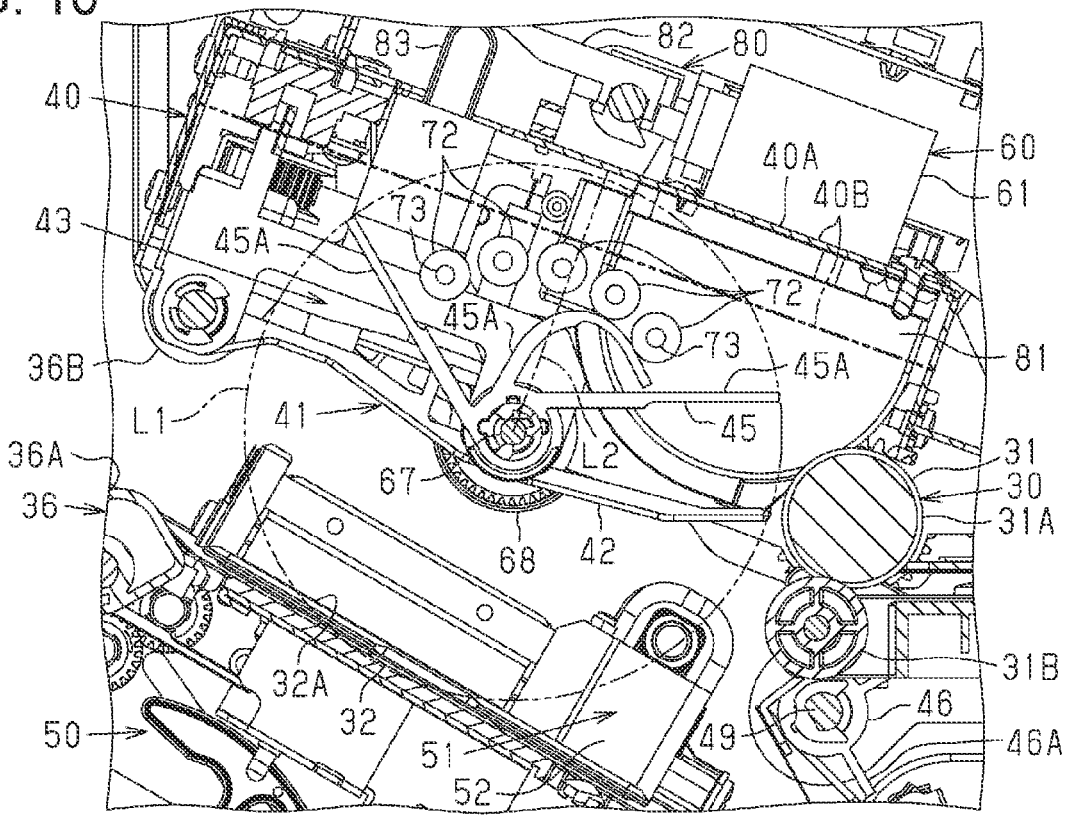
FIG. 10 is a side cross-sectional view illustrating the periphery of a paddle unit of a post-processing device according to a second embodiment.

As illustrated in FIG. 10, in the present embodiment, rollers 72, which are an example of a plurality of rotating bodies, are provided between the rotation shaft 67 of the first paddle 45 and the upper surface portion 40B of the paddle unit frame 40A in the paddle unit 40. The plurality of rollers 72 are each supported so as to be rotatable around a support shaft 73 which is an example of a shaft. In the side view illustrated in FIG. 10, the plurality of rollers 72 are arranged so as to draw an arc around the rotation shaft 67 of the first paddle 45. A second diameter, which is the diameter of the roller 72, is smaller than a first diameter, which is the diameter of the roller 70 in the first embodiment. Further, the plurality of rollers 72 are positioned within the rotation locus L1 of the first paddle 45.

At least one roller 72 is provided, between the rotation shaft 67 and the paddle unit frame 40A, at a position where the distance between the rotation shaft 67 and the paddle unit frame 40A is shortest. In other words, in the side view illustrated in FIG. 10, at least one roller 72 is provided at a position on a virtual line L2 coupling two positions, corresponding to the shortest distance between the rotation shaft 67 and the paddle unit frame 40A. Note that, when being arranged at the position where the distance is shortest, it is sufficient that the roller 72 is at least partially positioned on the virtual line L2.

Since the diameter of the roller 72 of the second embodiment is smaller than that of the roller 70 of the first embodiment, the size of the roller 72 in the height direction is relatively smaller than that of the roller 70 by the decreased magnitude of the diameter. Therefore, in the side view in FIG. 10, a space between a roller row in which the plurality of rollers 72 are arranged in an arc shape and the upper surface portion 40B of the paddle unit frame 40A is wider than that in the configuration of the first embodiment in the height direction. Therefore, as the components of the driving mechanisms 60 and 80 are arranged in this space, the space inside the paddle unit frame 40A can be efficiently used as an arrangement space.

Further, the height position of the upper surface portion 40B of the paddle unit frame 40A may be shifted downward, instead of arranging the components in the space described above. That is, the arrangement position of the upper surface portion 40B may be shifted up to the position indicated by the line with alternating long and two short dashes in FIG. 10 in a direction (downward) to become closer to the rotation shaft 67 of the first paddle 45 by the size of a saved space in which the blades 45A are not positioned. Also with this configuration, it is possible to relatively reduce the size of the paddle unit 40 in the height direction by shifting the height position of the upper surface portion 40B downward. In this configuration, the upper surface portion 40B of the paddle unit frame 40A is partially positioned within the rotation locus L1 of the first paddle 45.

A friction coefficient between the roller 72, which is an example of the rotating body, and the support shaft 73 is smaller than a friction coefficient between the roller 72 and the first paddle 45. The first paddle 45 in this example is formed of, for example, synthetic rubber. Further, at least a surface portion of the roller 72 is formed of a synthetic resin. Further, a portion of an inner circumferential surface into which the support shaft 73 of the roller 72 is inserted is formed of a synthetic resin. In addition, the support shaft 73 is formed of a synthetic resin. Therefore, the friction coefficient between the roller 72 and the support shaft 73 is a friction coefficient between synthetic resins. Further, the friction coefficient between the roller 72 and the first paddle 45 is a friction coefficient between a synthetic resin and rubber. The friction coefficient between a synthetic resin and rubber is larger than the friction coefficient between synthetic resins. Therefore, in the present embodiment, the friction coefficient between the roller 72 and the support shaft 73 is smaller than the friction coefficient between the roller 72 and the first paddle 45.

As specifically described above, according to the second embodiment, the roller 72 is included as an example of the rotating body, and thus, it is possible to obtain the following effects in addition to the effects (1) to (3) similarly to the first embodiment in which the roller 70 is included.

(4) Since the plurality of rollers 72 are arranged, it is possible to reduce the diameter of the roller 72. Therefore, the size of the space occupied by the roller 72 in the height direction does not have to be large. As a result, it is possible to secure an empty space having a large size in the height direction between the roller 72 and the upper surface portion 40B of the paddle unit frame 40A which is an example of the upper member. When the components are arranged in this empty space, it is possible to reduce the size of the paddle unit 40 in the height direction. Meanwhile, it is possible to reduce the size of the paddle unit 40 in the height direction by using the empty space for lowering the arrangement position of the upper surface portion 40B. As the size of the paddle unit 40 in the height direction is reduced, it is possible to reduce the size of the post-processing device 14 in the height direction.

Third Embodiment

Next, a third embodiment will be described with reference to FIG. 11. Note that the configuration of the rotating body included in the paddle unit 40 is different from each embodiment described above, and other components of the paddle unit 40 and the components in the recording system 11 and the post-processing device 14 are the same as those of the first embodiment. Therefore, only the configuration of the paddle unit 40 of the present embodiment will be described below.

Figure 11:
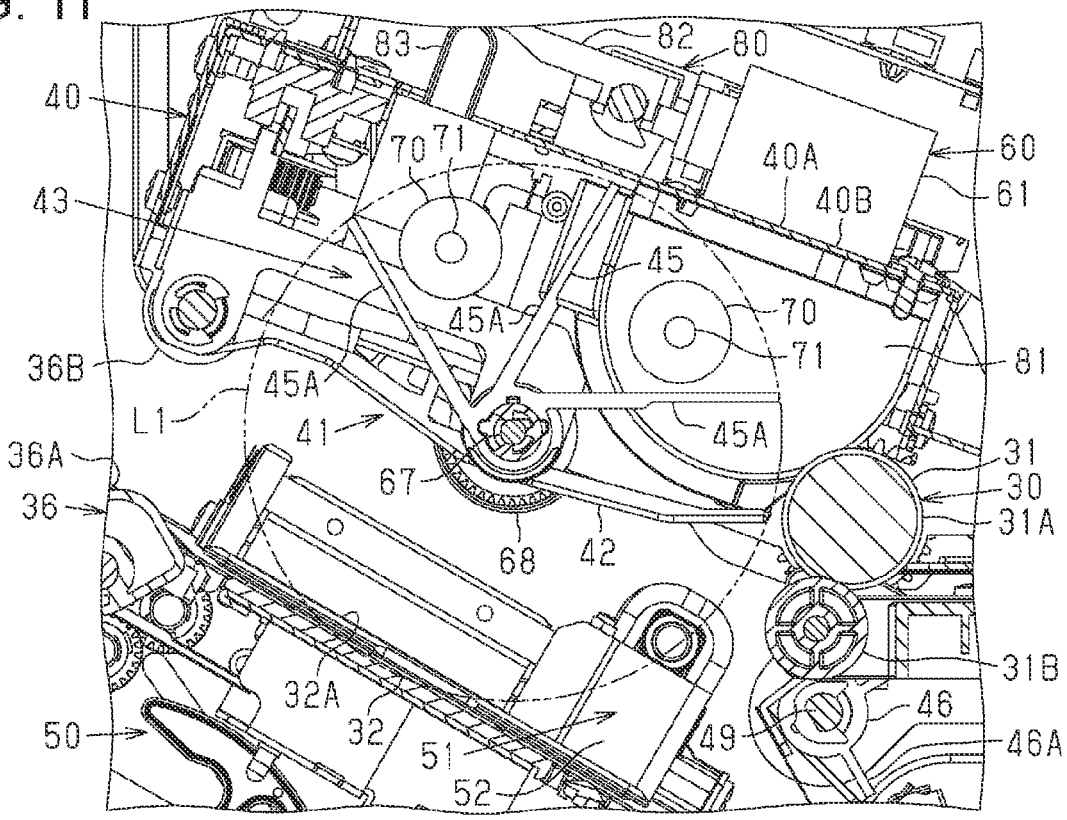
FIG. 11 is a side cross-sectional view illustrating the periphery of a paddle unit of a post-processing device according to a third embodiment.

As illustrated in FIG. 11, in the present embodiment, rollers 70, which are an example of a plurality of rotating bodies, are provided between the rotation shaft 67 of the first paddle 45, which is an example of the transportation member, and the upper surface portion 40B of the paddle unit frame 40A in the paddle unit 40. In this example, two rollers 70 are positioned while being spaced apart from each other in a rotation direction of the first paddle 45. The roller 70 is the same as the roller 70 of the first embodiment, but the number and arrangement positions of the rollers 70 are different from those in the first embodiment. Two rollers 70 are positioned within the rotation locus L1 of the first paddle 45. Further, the upper surface portion 40B is not positioned within the rotation locus L1, but the paddle unit frame 40A is partially positioned within the rotation locus L1 in the side view illustrated in FIG. 11. Note that the upper surface portion 40B may be partially positioned within the rotation locus L1. In this case, the distal end of the blade 45A comes into contact with the upper surface portion 40B when the first paddle 45 rotates, but the sliding due to the contact occurs only when the blade 45A is positioned between two rollers 70, thereby the wear of the blade 45A is reduced.

Two rollers 70 are arranged at positions on opposite sides of one blade 45A, of which the distal end is positioned uppermost, in the rotation direction when the first paddle 45 is in the wait posture. In the example illustrated in FIG. 11, when the first paddle 45 is in the wait posture, the (second) blade 45A positioned in the middle among three blades 45A extends upward. Further, all of three blades 45A face upward from the horizontal plane. One roller 70 is arranged between the first blade 45A and the second blade 45A, and the other roller 70 is arranged between the second blade 45A and the third blade 45A. Therefore, when the first paddle 45 is in the wait posture, the blade 45A is not in contact with the roller 70. In the first and second embodiments, when the first paddle 45 is in the wait posture, the blade 45A is in contact with the roller 70 of the first embodiment or the roller 72 of the second embodiment and is kept to be in the bent state. Therefore, there is a possibility that a bending tendency is imparted to the blade 45A. On the other hand, in the present embodiment, when the first paddle 45 is in the wait posture, the blade 45A is in a non-contact state in which the blade 45A is not in contact with the roller 70, and thus, the bending tendency is suppressed from being imparted to the blade 45A.

The plurality of rollers 70 are each supported so as to be rotatable around the support shaft 71. In the side view illustrated in FIG. 11, the plurality of rollers 70 are arranged at positions whose distances from the rotation shaft 67 of the first paddle 45 are the same as each other.

When the first paddle 45 rotates, the blade 45A sequentially comes into contact with the plurality of rollers 70, and the blade 45A is bent due to the contact. A space, in which the blade 45A is not positioned because the blade 45A of the first paddle 45 comes into contact with the outer circumferential surface of the roller 70 and is bent, is secured on the outer circumferential side of the plurality of rollers 70 with respect to the rotation shaft 67 of the first paddle 45. Therefore, this space can be efficiently used as the arrangement space for the components of the driving mechanisms 60 and 80, or the like. Note that, in the present embodiment, the paddle unit frame 40A is partially positioned within the rotation locus L1 of the first paddle 45 in the side view illustrated in FIG. 11.

The first paddle 45 which is an example of the transportation member can be switched between a transport posture in which the first paddle 45 comes into contact with the medium 12 to transport the medium 12 (see FIGS. 7 to 9), and a wait posture in which the first paddle 45 is not in contact with the medium 12 and the distal end of the first paddle 45 faces upward (see FIG. 11). When the first paddle 45 is in the wait posture, the first paddle 45 and the roller 70 overlap each other when viewed from the side in the vertical direction Z. As the paddle unit frame 40A and the first paddle 45 overlap each other in a device height direction or medium loading direction, it is possible to reduce the size of the paddle unit 40 in the height direction and reduce the size of the post-processing device 14 in the height direction. In addition, it is possible to prevent the deformation of the blade 45A of the first paddle 45.

Further, when the first paddle 45 is at the wait position, the first paddle 45 and the roller 70 are not in contact with each other in a state where the blade 45A, which is a transportation member of the first paddle 45, faces upward, and the first paddle 45 and the roller 70 overlap each other when viewed from the side in the vertical direction Z. In the wait posture, the first paddle 45 is not in contact with the roller 70, the deformation of the blade 45A of the first paddle 45 is prevented. Note that the overlapping between the first paddle 45 and the roller 70 in the vertical direction Z is not limited to overlapping in the vertical direction Z which is the "device height direction", and may include overlapping in the "medium loading direction" orthogonal to the loading surface 32A of the processing tray 32 that is inclined with respect to the horizontal plane.

A friction coefficient between the roller 70, which is an example of the rotating body, and the support shaft 71 is smaller than a friction coefficient between the roller 70 and the first paddle 45. In this example, the materials of the first paddle 45, the roller 70, and the support shaft 71 are the same as those in the first embodiment.

As specifically described above, according to the third embodiment, it is possible to obtain the following effects in addition to the effects (1) and (3) similarly to the first embodiment.

(5) The first paddle 45 can be switched between the transport posture in which the first paddle 45 comes into contact with the medium 12 to transport the medium 12, and the wait posture in which the first paddle 45 is not in contact with the medium 12 and the distal end of the first paddle 45 faces upward. When the first paddle 45 is in the wait posture, the first paddle 45 and the roller 70 overlap each other when viewed from the side in the vertical direction. Note that it is sufficient that the overlapping described above is overlapping in the "device height direction" or the "direction in which the medium 12 is loaded". As the paddle unit frame 40A and the first paddle 45 overlap each other (in the device height direction or the direction in which the medium 12 is loaded), the size of the device is reduced, and the deformation of the first paddle 45 is also prevented.

(6) The first paddle 45 can be switched between the transport posture in which the first paddle 45 comes into contact with the medium 12 to transport the medium 12, and the wait posture in which the first paddle 45 is not in contact with the medium 12 and the distal end of the first paddle 45 faces upward. At the wait position, the first paddle 45 and the roller 70 are not in contact with each other in a state where the first paddle 45 faces upward, and the first paddle 45 and the roller 70 overlap each other when viewed from the side in the vertical direction. Therefore, the deformation of the first paddle 45 in the wait posture is prevented.

Fourth Embodiment

Next, a fourth embodiment will be described with reference to FIG. 12. Note that the configuration of the paddle unit 40 is different from each embodiment described above, and other components in the recording system 11 and the post-processing device 14 are the same as those of the first embodiment. Therefore, only the configuration of the paddle unit 40 of the present embodiment will be described below.

Figure 12:
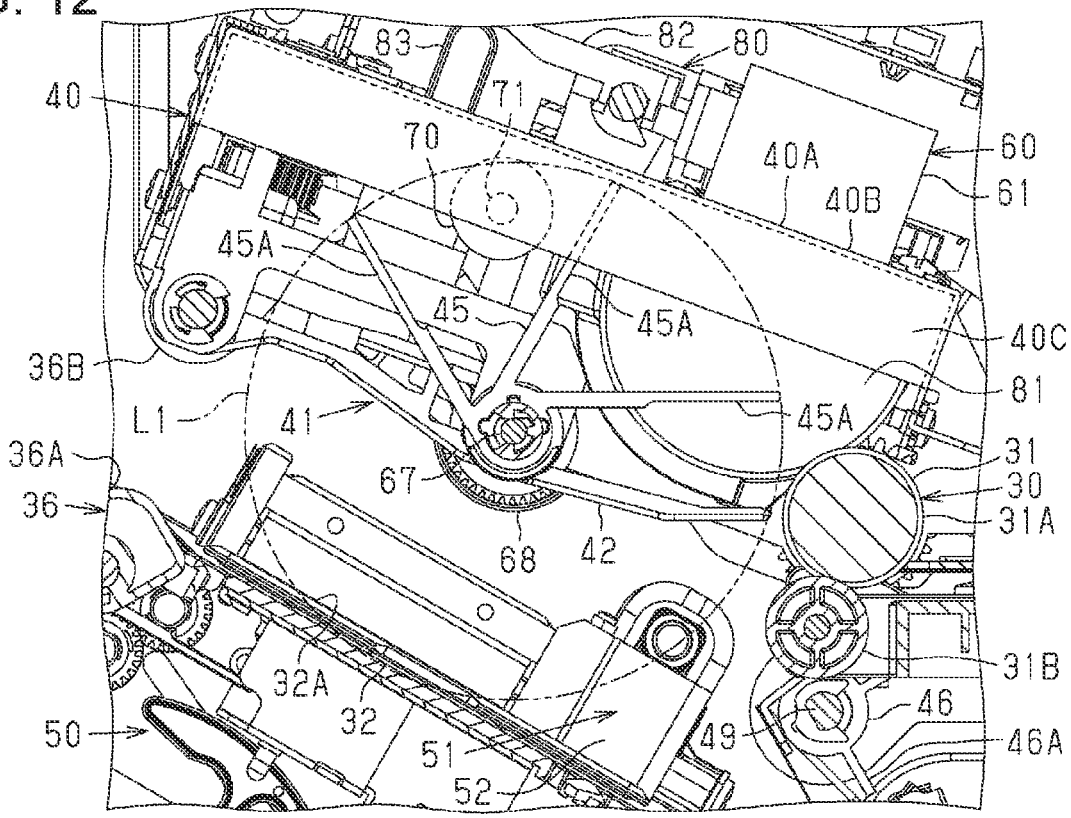
FIG. 12 is a side cross-sectional view illustrating the periphery of a paddle unit of a post-processing device according to a fourth embodiment.

As illustrated in FIG. 12, in the present embodiment, a roller 70, which is an example of the rotating body, is provided between the rotation shaft 67 of the first paddle 45 and the upper surface portion 40B of the paddle unit frame 40A in the paddle unit 40. The paddle unit frame 40A includes an extending portion 40C that extends downward from the upper surface portion 40B at a substantially uniform length. A pair of extending portions 40C is formed at positions on opposite sides of the roller 70 and the first paddle 45 in the axial direction (width direction X) of the rotation shaft 67 of the first paddle 45. When the first paddle 45 is configured to be movable in the axial direction, the pair of extending portions 40C may be formed at positions on opposite sides of a movement region of the first paddle 45 in the axial direction. The roller 70 is the same as the roller 70 of the first embodiment. Opposite end portions of the support shaft 71 of the roller 70 are supported by the pair of extending portions 40C. The roller 70 is supported so as to be rotatable with respect to the support shaft 71. Note that, instead of the pair of extending portions 40C, one extending portion 40C may be formed on only one of the opposite sides of the roller 70 and the first paddle 45, and in this case, a side plate portion that supports the rotation shaft 67 in the paddle unit frame 40A may double as the extending portion 40C on the other side.

The roller 70 is positioned within the rotation locus L1 of the first paddle 45. As illustrated in FIG. 12, an upper side portion of the roller 70 may be partially positioned outside the rotation locus L1. As such, the support shaft 71 may be positioned within the rotation locus L1, and the roller 70 may be partially positioned within the rotation locus L1. Further, the upper surface portion 40B is not positioned within the rotation locus L1, but the extending portion 40C which is a part of the paddle unit frame 40A is partially positioned within the rotation locus L1 in the side view illustrated in FIG. 12. Note that the upper surface portion 40B may be partially positioned within the rotation locus L1. In this case, the distal end of the blade 45A comes into contact with the upper surface portion 40B when the first paddle 45 rotates, but the contact is not made when the blade 45A comes into contact with the roller 70, is deformed, and is thus separated from the upper surface portion 40B. Therefore, the wear of the blade 45A is reduced.

The roller 70, which is an example of the rotating body, is provided in the paddle unit frame 40A which is an example of the upper member. The lower end of the roller 70 protrudes downward from the lower surface of the extending portion 40C of the paddle unit frame 40A. Note that it is sufficient that the roller 70 at least partially protrudes downward from the extending portion 40C of the paddle unit frame 40A. That is, as the positions of the roller 70 and the paddle unit frame 40A overlap each other in the height direction, the size of the paddle unit 40 in the height direction may be reduced.

When the first paddle 45, which is an example of the transportation member, is in the wait posture, the roller 70 is arranged at a non-contact position at which the roller 70 comes into contact with none of the plurality of blades 45A. In the example illustrated in FIG. 12, when the first paddle 45 is in the wait posture, the roller 70 is arranged between the first blade 45A and the second blade 45A among three blades 45A. Therefore, when the first paddle 45 is in the wait posture, the blade 45A is not in contact with the roller 70. In the first and second embodiments, when the first paddle 45 is in the wait posture, the blade 45A is in contact with the roller 70 of the first embodiment or the roller 72 of the second embodiment and is kept to be in the bent state. Therefore, there is a possibility that a bending tendency is imparted to the blade 45A. On the other hand, in the present embodiment, when the first paddle 45 is in the wait posture, the blade 45A is in a non-contact state in which the blade 45A is not in contact with the roller 70, and thus, the bending tendency is suppressed from being imparted to the blade 45A.

When the first paddle 45 rotates from the wait posture, the blade 45A sequentially comes into contact with the roller 70, and the blade 45A is bent due to the contact. When the roller 70 is viewed from the rotation shaft 67 of the first paddle 45, the blade 45A is not positioned in a space on the opposite side (outer circumferential side) of the roller 70, because the blade 45A of the first paddle 45 comes into contact with the outer circumferential surface of the roller 70 and is bent. When the roller 70 is viewed from the rotation shaft 67 of the first paddle 45, a space, in which the blade 45A is not positioned, is secured on the opposite side (outer circumferential side) of the roller 70. This space can be efficiently used as the arrangement space for the components of the driving mechanisms 60 and 80, or the like. Note that, in this configuration, the extending portion 40C, which is a part of the paddle unit frame 40A is positioned within the rotation locus L1 of the first paddle 45.

The first paddle 45 can be switched between the transport posture in which the first paddle 45 comes into contact with the medium 12 to transport the medium 12 (see FIGS. 7 to 9), and the wait posture in which the first paddle 45 is not in contact with the medium 12 and the distal end of the first paddle 45 faces upward (see FIG. 11). When the first paddle 45 is in the wait posture, the first paddle 45 and the roller 70 overlap each other when viewed from the side in the vertical direction Z. Note that the overlapping between the first paddle 45 and the roller 70 in the vertical direction Z may be overlapping in the "device height direction" or "medium loading direction", similarly to the third embodiment.

Further, when the first paddle 45 is in the wait posture, the first paddle 45 and the roller 70 are not in contact with each other in a state where the blade 45A, which is a transportation member of the first paddle 45, faces upward, and the first paddle 45 and the roller 70 overlap each other in the vertical direction Z. In the wait posture, the first paddle 45 is not in contact with the roller 70.

A friction coefficient between the roller 70, which is an example of the rotating body, and the support shaft 71 is smaller than a friction coefficient between the roller 70 and the first paddle 45. In this example, the materials of the first paddle 45, the roller 70, and the support shaft 71 are the same as those in the first embodiment.

As specifically described above, according to the fourth embodiment, it is possible to obtain the following effects, in addition to the effects (1) and (3) in the first embodiment, and the effects (5) and (6) in the second embodiment.

(7) The roller 70 is provided in the paddle unit frame 40A. The lower end of the roller 70 protrudes downward from the lower surface of the paddle unit frame 40A. Note that it is sufficient that the roller 70 at least partially protrudes from the paddle unit frame 40A. Therefore, as the roller 70 and the paddle unit frame 40A overlap each other, it is possible to achieve size reduction.

Fifth Embodiment

Next, a fifth embodiment will be described with reference to FIG. 13. Note that the configuration of the paddle unit 40 is different from each embodiment described above, and other components in the recording system 11 and the post-processing device 14 are the same as those of the first embodiment. Therefore, only the configuration of the paddle unit 40 of the present embodiment will be described below.

Figure 13:
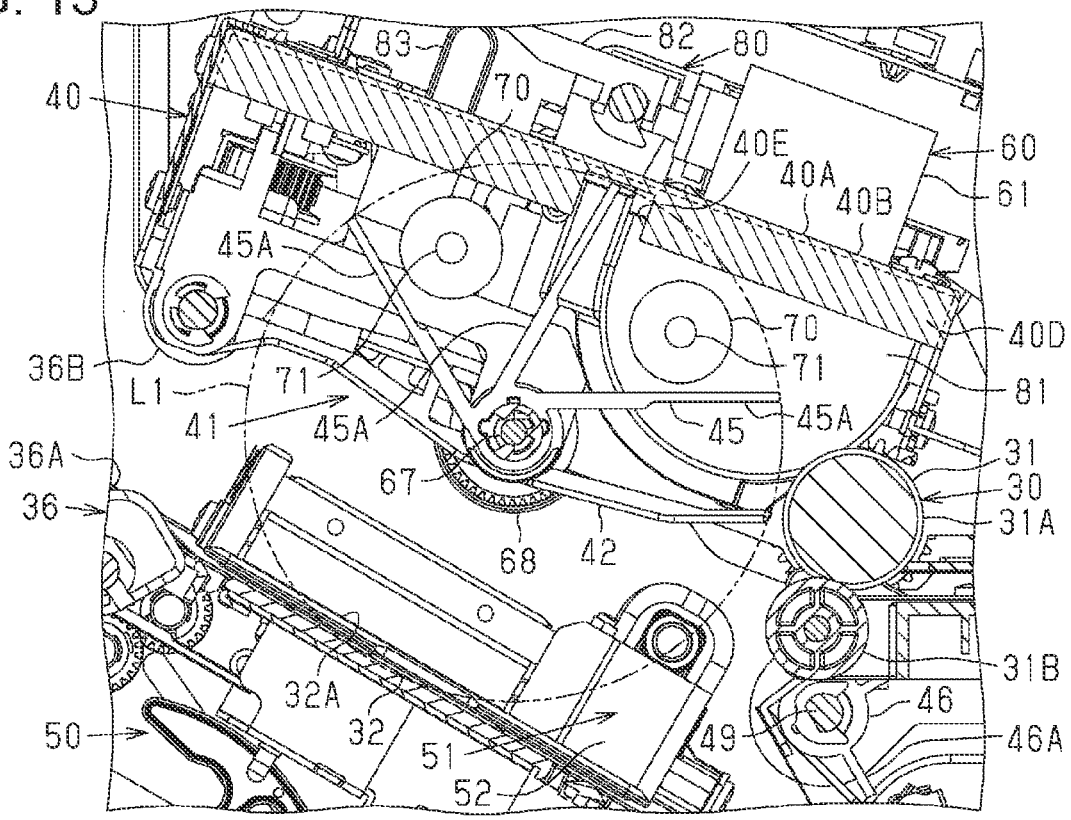
FIG. 13 is a side cross-sectional view illustrating the periphery of a paddle unit of a post-processing device according to a fifth embodiment.

As illustrated in FIG. 13, in the present embodiment, rollers 70, which are an example of a plurality of rotating bodies, are provided between the rotation shaft 67 of the first paddle 45, which is an example of the transportation member, and the upper surface portion 40B of the paddle unit frame 40A in the paddle unit 40. The upper surface portion 40B is a thick portion 40D whose thickness is larger than that of the upper surface portion 40B of the third embodiment, or has a thick portion 40D whose thickness of a portion corresponding to the rotation locus L1 of the first paddle 45 is larger than that of the upper surface portion 40B of the third embodiment. The roller 70 is the same as the roller 70 of the third embodiment, but the number and arrangement positions of the rollers 70 are also substantially the same as those in the third embodiment. That is, two rollers 70 are provided.

Two rollers 70 are positioned within the rotation locus L1 of the first paddle 45. Further, the upper surface portion 40B is partially positioned within the rotation locus L1 of the first paddle 45. A part of the paddle unit frame 40A and two rollers 70 are positioned within the rotation locus L1 in the side view illustrated in FIG. 13.

Two rollers 70 are each supported so as to be rotatable around the support shaft 71. In the side view illustrated in FIG. 13, two rollers 70 are arranged at positions whose distances from the rotation shaft 67 of the first paddle 45 are the same as each other.

Two rollers 70 are arranged at positions on opposite sides of one blade 45A, of which the distal end is positioned uppermost, among the plurality of blades 45A in the rotation direction when the first paddle 45 is in the wait posture. In the example illustrated in FIG. 13, when the first paddle 45 is in the wait posture, the (second) blade 45A positioned in the middle among three blades 45A extends upward. One roller 70 is arranged between the first blade 45A and the second blade 45A, and the other roller 70 is arranged between the second blade 45A and the third blade 45A.

Therefore, when the first paddle 45 is in the wait posture, the blade 45A is not in contact with the roller 70.

In the present embodiment, a recessed portion 40E is formed in the thick portion 40D of the upper surface portion 40B of the paddle unit frame 40A. The recessed portion 40E has a recessed shape that is recessed upward from the lower surface of the thick portion 40D. In the wait posture of the first paddle 45, a distal end portion of one blade 45A whose distal end is positioned uppermost among the plurality of blades 45A of the first paddle 45 is received in the recessed portion 40E. In the first and second embodiments, when the first paddle 45 is in the wait posture, the blade 45A is in contact with the roller 70 of the first embodiment or the roller 72 of the second embodiment and is kept to be in the bent state. Therefore, there is a possibility that a bending tendency is imparted to the blade 45A. On the other hand, in the present embodiment, similarly to the third embodiment, when the first paddle 45 is in the wait posture, the blade 45A is in a non-contact state in which the blade 45A is not in contact with the roller 70 and the paddle unit frame 40A, and thus, the bending tendency is suppressed from being imparted to the blade 45A.

When the first paddle 45 rotates, the blade 45A sequentially comes into contact with the plurality of rollers 70, and the blade 45A is bent due to the contact. A space, in which the blade 45A is not positioned because the blade 45A of the first paddle 45 comes into contact with the outer circumferential surface of the roller 70 and is bent, is secured on the outer circumferential side of the plurality of rollers 70 with respect to the rotation shaft 67 of the first paddle 45. Therefore, this space can be efficiently used as the arrangement space for the components of the driving mechanisms 60 and 80, or the like.

The first paddle 45 can be switched between the transport posture in which the first paddle 45 comes into contact with the medium 12 to transport the medium 12 (see FIGS. 7 to 9), and the wait posture in which the first paddle 45 is not in contact with the medium 12 and the distal end of the first paddle 45 faces upward (see FIG. 11). When the first paddle 45 is in the wait posture, the first paddle 45 and the roller 70 overlap each other when viewed from the side in the vertical direction Z. The paddle unit frame 40A and the first paddle 45 may overlap each other in the device height direction or medium loading direction.

Further, when the first paddle 45 is in the wait posture, the first paddle 45 and the roller 70 are not in contact with each other in a state where the blade 45A, which is a transportation member of the first paddle 45, faces upward, and the first paddle 45 and the roller 70 overlap each other when viewed from the side in the vertical direction Z. In the wait posture, the first paddle 45 is not in contact with the roller 70.

A friction coefficient between the roller 70, which is an example of the rotating body, and the support shaft 71 is smaller than a friction coefficient between the roller 70 and the first paddle 45. In this example, the materials of the first paddle 45, the roller 70, and the support shaft 71 are the same as those in the first embodiment.

As specifically described above, according to the fifth embodiment, it is possible to obtain the following effects, in addition to the effects (1) and (3) in the first embodiment, and the effects (5) and (6) in the second embodiment.

(8) The recessed portion 40E is provided in the paddle unit frame 40A. In the wait posture, the distal end of the first paddle 45 is received in the recessed portion 40E. As the paddle unit frame 40A and the first paddle 45 overlap each other in the device height direction or medium loading direction, the size of the device is reduced, and the deformation of the first paddle 45 is also prevented.

Note that modifications of the above-described embodiments, such as the following modified examples, can be made. Moreover, one which is obtained by appropriately combining the above-described embodiments and the following modified examples can become another modified example, or one which is obtained by appropriately combining the following modified examples can also become another modified example.

Figure 14:
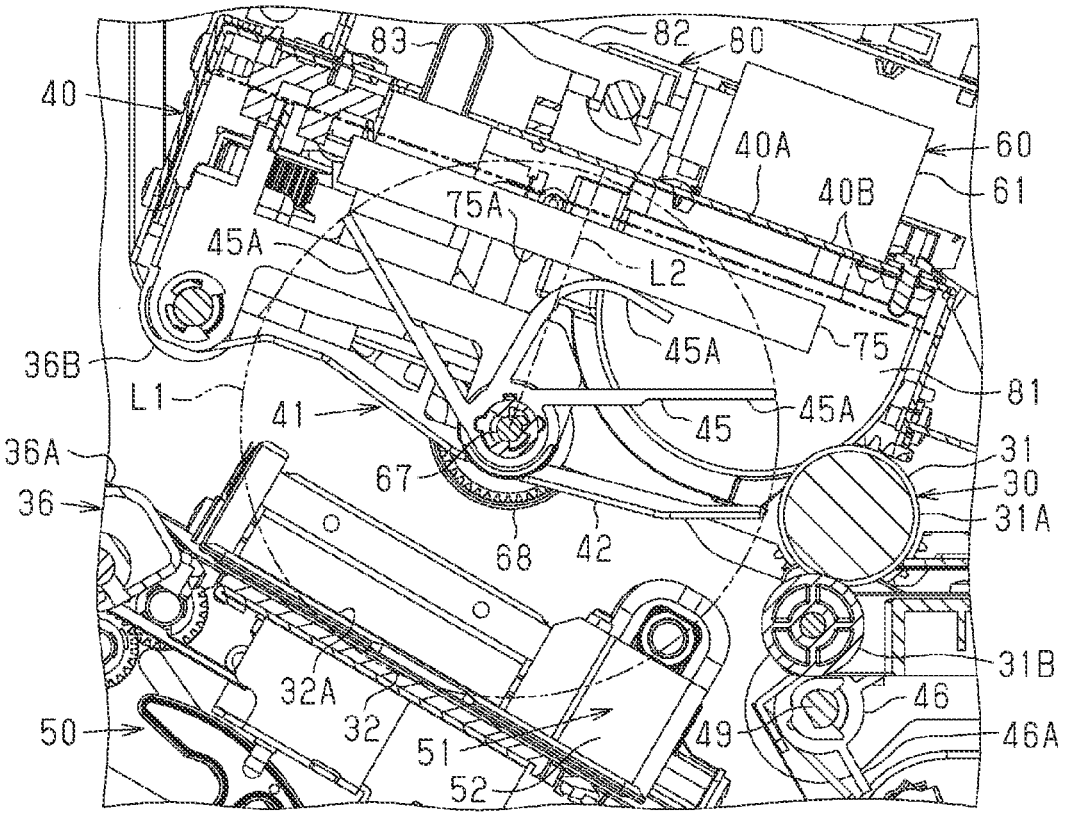
FIG. 14 is a side cross-sectional view illustrating the periphery of a paddle unit of a post-processing device according to a modified example.

The member that comes into contact with the first paddle 45, which is an example of the transportation member, does not have to be the rotating body such as the roller 70. For example, as illustrated in FIG. 14, the member may be a plate 75 which is a low friction member. A surface of the plate 75 that faces the first paddle 45 is a low friction surface 75A formed of a low friction material. Further, the plate 75 is arranged so as to be positioned within the rotation locus L1 of the first paddle 45. In the example in FIG. 14, the plate 75 is at least partially positioned within the rotation locus L1 of the first paddle 45. As the components are arranged in a space between the plate 75 and the upper surface portion 40B, or the upper surface portion 40B is arranged at a position indicated by a line with alternating long and two short dashes within the rotation locus L1, it is possible to reduce the size of the paddle unit 40 in the height direction. Further, in the side view illustrated in FIG. 14, the plate 75 is provided at a position on a virtual line L2 coupling two positions, corresponding to the shortest distance between the rotation shaft 67 and the paddle unit frame 40A. Also with this configuration, it is possible to suppress the wear of the first paddle 45, and reduce the size of the post-processing device 14 in the height direction, similarly to each embodiment described above. Note that, instead of the plate 75, the low friction member may have other shapes such as a columnar shape.

The rotating body may be a rotation belt. A frictional resistance between the blade 45A of the first paddle 45 and the rotation belt is larger than a frictional resistance between a shaft of each of a plurality of rollers around which the rotation belt is wound, and a bearing.

The rotating body may also be a ball. For example, a plurality of balls are provided so that some of the balls are exposed to a surface of a plate that faces the first paddle 45. However, when the rotating body is a ball, the ball and the blade 45A of the first paddle 45 come into point-contact with each other, and therefore, the blade more easily wears as compared with the columnar rotating body such as a roll. Therefore, for example, a plurality of balls may be provided so that some of the balls are exposed to the surface of the plate that faces the first paddle 45.

The first paddle 45 may be provided so as not to be movable in the axial direction of the rotation shaft 67.

The roller 70 may be moved in the width direction X according to the movement of the first paddle 45 in the width direction X.

In the third embodiment, in the side view when viewed from the shaft line direction of the support axis, the entire rotating body may be hidden inside the upper member. That is, the roller 70, which is an example of the rotating body, may be hidden by the extending portion 40C of the paddle unit frame 40A, which is an example of the upper member.

It is sufficient that the upper member and the rotating body are at least partially positioned within the rotation locus of the transportation member.

The rotating body may be applied to the second paddle 46. That is, the rotating body such as a roller may be arranged at a position with which the second paddle 46 comes into contact. The rotating body may be positioned within the rotation locus of the second paddle 46. Further, when applying the rotating body to the second paddle 46, since the second paddle is positioned below the transport mechanism 30, a frame forming the transport mechanism 30 corresponds to an example of the upper member.

Motors for other use may be used as the driving source of the paddles 45 and 46.

The receiving mechanism 41 that guides the medium 12 to make the medium 12 be received on the processing tray 32 is not limited to a configuration including the variable guide 42. For example, the receiving mechanism 41 may be an adsorption transport belt that adsorbs and transports the medium. An adsorption method of the adsorption transport belt includes a negative pressure, static electricity, and the like. In this case, the adsorption transport belt may make the medium 12 be received by adsorbing the medium 12 discharged from the transport mechanism 30 to a position above the processing tray 32 in the transport direction Y0, and transporting the medium 12 to a position above the processing tray 32, and then releasing the adsorption or forcibly separating the medium 12 from the belt with a movable guide or the like, and dropping the medium 12 onto the loading surface 32A. Further, after the medium 12 adsorbed to the adsorption transport belt is transported in the transport direction Y0, a movement direction of the belt is reversed to switch back the medium 12 in the second transport direction which is a direction opposite to the transport direction Y0. Further, in a process in which the medium 12 is transported in the second transport direction, the medium 12 may be dropped onto the loading surface 32A and received in a manner in which the medium 12 is separated from the adsorption transport belt or the adsorption of the medium 12 is released.

The intermediate device 15 does not have to be provided in the recording system 11. That is, the recording system 11 may be constituted by the recording device 13 and the post-processing device 14. Further, the reversing processing section 200 of the intermediate device 15 may be incorporated in the post-processing device 14. In this case, the post-processing device 14 performs post-processing when the medium 12 transported from the recording device 13 is reversed therein and then received on the processing tray 32. Further, the reversing processing section 200 of the intermediate device 15 may be incorporated in the recording device 13. In this case, the post-processing device 14 performs post-processing on the medium 12 that is transported from the recording device 13, is reversed, is subjected to recording, and then is received on the processing tray 32.

Although the recording system 11 includes the recording device 13 and the post-processing device 14 in the embodiments described above, a configuration in which the recording device 13 includes the post-processing device 14 is also possible. In other words, the post-processing device 14 may include the recording device 13.

The medium 12 is not limited to a paper sheet, and may be a film or sheet formed of a synthetic resin, a fabric, a non-woven fabric, a laminate sheet, or the like.

The recording device 13 is not limited to an ink jet printer, and may be an ink jet textile printing device. Further, the recording device 13 may also be a multifunction printer including a scanner mechanism and having a copy function in addition to the recording function.

Hereinafter, the technical idea of the embodiments and the modified examples described above will be described with the effects.

(A) A post-processing device includes: a processing tray on which a medium subjected to recording by a recording portion is loaded; a transportation member provided above the processing tray and rotating to transport the medium toward upstream in a transport direction; a rotating body provided above a rotation shaft of the transportation member; and an upper member provided above the rotating body, in which the rotating body and the upper member are positioned within a rotation locus of the transportation member. Note that it is sufficient that the upper member and the rotating body are at least partially positioned within the rotation locus.

With this configuration, it is possible to suppress the wear of the transportation member and reduce the size of the post-processing device 14.

(B) In the post-processing device, the transportation member may be rotatable around the rotation shaft to transport the medium, and the rotating body may be provided, between the rotation shaft and the upper member, at a position where a distance between the rotation shaft and the upper member is shortest. Note that, when being arranged at the position where the distance is shortest, it is sufficient that the roller is at least partially positioned on a line indicating the shortest distance.

With this configuration, the rotating body is provided at a position where the transportation member is deformed the most, such that the friction is reduced.

(C) In the post-processing device, the rotating body may be provided in the upper member, and a lower end of the rotating body may protrude downward from a lower surface of the upper member. Note that it is sufficient that the rotating body at least partially protrudes from the upper member.

With this configuration, as the rotating body and the upper member overlap each other, it is possible to achieve size reduction.

(D) In the post-processing device, the transportation member may be configured to be switched between a transport posture in which the transportation member comes into contact with the medium to pull in the medium, and a wait posture in which the transportation member is not in contact with the medium and a distal end of the transportation member faces upward, and when the transportation member is in the wait posture, the transportation member and the rotating body may overlap each other in a vertical direction. Note that it is sufficient that the overlapping in the vertical direction is overlapping in the "device height direction" or the "medium loading direction".

With this configuration, as the upper member and the transportation member overlap each other (in the device height direction or medium loading direction), the size of the device is reduced, and the deformation of the transportation member is also prevented.

(E) In the post-processing device, the transportation member may be configured to be switched between the transport posture in which the transportation member comes into contact with the medium to transport the medium, and the wait posture in which the transportation member is not in contact with the medium and the distal end of the transportation member faces upward, and when the transportation member is in the wait posture, the transportation member and the rotating body are not in contact with each other in a state where the transportation member faces upward, and the transportation member and the rotating body may overlap each other in the vertical direction.

With this configuration, the deformation of the transportation member in the waiting posture is prevented.

(F) In the post-processing device, a recessed portion is provided in the upper member, and when the transportation member is in the wait posture, the distal end of the transportation member may be received in the recessed portion.

With this configuration, as the upper member and the transportation member overlap each other in the device height direction or medium loading direction, the size of the device is reduced, and the deformation of the transportation member is also prevented.

(G) In the post-processing device, a friction coefficient between the rotating body and a shaft of the rotating body may be smaller than a friction coefficient between the rotating body and the transportation member.

With this configuration, the transportation member and the rotating body may favorably rotate when coming into contact with each other. Since the sliding of the transportation member and the rotating body relative to each other does not occur or is suppressed, it is possible to suppress the wear caused by the sliding of the transportation member and the rotating body relative to each other.

What is claimed is:

1. A post-processing device comprising:

a processing tray on which a medium recorded by a recording portion is loaded;

a transportation member that is provided above the processing tray, and, by rotating around a rotation shaft, transports the medium toward upstream in a transport direction;

a rotating body provided above the rotation shaft of the transportation member; and an upper member provided above the rotating body, wherein the rotating body and the upper member are positioned within a rotation locus of the transportation member, and wherein the transportation member comes into contact with the rotating body at a time of rotating.

2. The post-processing device according to claim 1, wherein the rotating body is provided, between the rotation shaft and the upper member, at a position where a distance between the rotation shaft and the upper member is shortest.

3. The post-processing device according to claim 1, wherein the rotating body is provided in the upper member, and a lower end of the rotating body protrudes downward from a lower surface of the upper member.

4. The post-processing device according to claim 1, wherein the transportation member is configured to be switched between a transport posture in which the transportation member comes into contact with the medium to transport the medium, and a wait posture in which the transportation member is not in contact with the medium and a distal end of the transportation member faces upward, and when the transportation member is in the wait posture, the transportation member and the rotating body overlap each other in a vertical direction when viewed from a side.

5. The post-processing device according to claim 1, wherein the transportation member is configured to be switched between a transport posture in which the transportation member comes into contact with the medium to transport the medium, and a wait posture in which the transportation member is not in contact with the medium and a distal end of the transportation member faces upward, and when the transportation member is in the wait posture, the transportation member and the rotating body are not in contact with each other, and the transportation member and the rotating body overlap each other in a vertical direction when viewed from a side.

6. The post-processing device according to claim 4, wherein the upper member has a recessed portion, and when the transportation member is in the wait posture, the distal end of the transportation member is received in the recessed portion.

7. The post-processing device according to claim 1, wherein a friction coefficient between the rotating body and a shaft of the rotating body is smaller than a friction coefficient between the rotating body and the transportation member.

8. The post-processing device according to claim 1, wherein the rotating body comprises a plurality of rotating bodies.

9. The post-processing device according to claim 8, wherein the plurality of rotating bodies are arranged so as to draw an arc around the transportation member.

10. The post-processing device according to claim 9, wherein at least one of the plurality of rotating bodies is provided, between the rotation shaft and the upper member, at a position where a distance between the rotation shaft and the upper member is shortest.

11. The post-processing device according to claim 8, wherein the plurality of rotating bodies are positioned while being spaced apart from each other in a rotation direction of the transportation member.

12. The post-processing device according to claim 11, wherein the transportation member is configured to be switched between a transport posture in which the transportation member comes into contact with the medium to transport the medium, and a wait posture in which the transportation member is not in contact with the medium and a distal end of the transportation member faces upward, and when the transportation member is in the wait posture, the transportation member and at least one of the plurality of rotating bodies overlap each other in a vertical direction when viewed from a side.

13. The post-processing device according to claim 11, wherein the transportation member is configured to be switched between a transport posture in which the transportation member comes into contact with the medium to transport the medium, and a wait posture in which the transportation member is not in contact with the medium and a distal end of the transportation member faces upward, and when the transportation member is in the wait posture, the transportation member and the plurality of rotating bodies are not in contact with each other, and the transportation member and at least one of the plurality of rotating bodies overlap each other in a vertical direction when viewed from a side.

14. A post-processing device comprising:

a processing tray on which a medium recorded by a recording portion is loaded;

a transportation member that is provided above the processing tray, and, by rotating around a rotation shaft, transports the medium toward upstream in a transport direction;

a rotating body provided above the rotation shaft of the transportation member; and an upper member provided above the rotating body, wherein the rotating body and the upper member are positioned within a rotation locus of the transportation member, and wherein a friction coefficient between the rotating body and a shaft of the rotating body is smaller than a friction coefficient between the rotating body and the transportation member.

15. A post-processing device comprising:

a processing tray on which a medium recorded by a recording portion is loaded;

a transportation member that is provided above the processing tray, and, by rotating around a rotation shaft, transports the medium toward upstream in a transport direction;

a rotating body provided above the rotation shaft of the transportation member; and an upper member provided above the rotating body, the upper member providing an arrangement space for a driving mechanism that drives the transportation member, wherein the rotating body and the upper member are positioned within a rotation locus of the transportation member.

* * * * *